US009362101B2

(12) United States Patent
Vertes et al.

(10) Patent No.: US 9,362,101 B2
(45) **Date of Patent: *Jun. 7, 2016**

(54) PLUME COLLIMATION FOR LASER ABLATION ELECTROSPRAY IONIZATION MASS SPECTROMETRY

(71) Applicant: The George Washington University, Washington, DC (US)

(72) Inventors: Akos Vertes, Reston, VA (US); Jessica A. Stolee, Washington, DC (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/477,112

(22) Filed: Sep. 4, 2014

(65) Prior Publication Data

US 2015/0053853 A1 Feb. 26, 2015

Related U.S. Application Data

(63) Continuation of application No. 13/549,988, filed on Jul. 16, 2012, now Pat. No. 8,829,426.

(60) Provisional application No. 61/507,836, filed on Jul. 14, 2011.

(51) Int. Cl.

| | |
|---|---|
| ***H01J 49/16*** | (2006.01) |
| ***H01J 49/04*** | (2006.01) |
| ***H01J 49/14*** | (2006.01) |

(52) U.S. Cl.

CPC ..... *H01J 49/167* (2013.01); *H01J 49/0404* (2013.01); *H01J 49/0463* (2013.01); *H01J 49/145* (2013.01); *H01J 49/165* (2013.01)

(58) Field of Classification Search

CPC ... H01J 49/04; H01J 49/0404; H01J 49/0418; H01J 49/0431; H01J 49/0459; H01J 49/0463; H01J 49/107; H01J 49/165; H01J 49/167

USPC ..... 250/281, 282, 288

See application file for complete search history.

(56) References Cited

U.S. PATENT DOCUMENTS 2,922,306 A * 1/1960 Crable ..... 73/864.85
5,012,052 A 4/1991 Hayes (Continued)

FOREIGN PATENT DOCUMENTS

DE 10310518 A1 10/2004
JP 2005-98909 A 4/2005

(Continued)

OTHER PUBLICATIONS

Hiraoka, Kenzo. "Laser Spray: Electric-Field Assisted Matrix Assisted Laser Desorption Ionization", J. Mass Spectrom, 2004, 39:341-350.*

Hiraoka, Kenzo, "Laser Spray: Electric-Field Assisted Matrix Assisted Laser Desorption Ionization," J. Mass Spectrom., 2004, 39; pp. 341-350.

Takubo Kenji, Ionizing Device and Mass Spectrometer Using the Same, Apr. 14, 2005.

Stockle et al., "Nanoscale Atmospheric Pressure Laser Ablation-Mass Spectrometry," Analytical Chemistry, Apr. 1, 2001, vol. 73, No. 7, pp. 1399-1402.

(Continued)

*Primary Examiner* — Nicole Ippolito
*Assistant Examiner* — David E Smith
(74) *Attorney, Agent, or Firm* — Cohen & Grigsby, P.C.

(57) ABSTRACT

In various embodiments, a device may generally comprise a capillary having a first end and a second end; a laser to emit energy at a sample in the capillary to ablate the sample and generate an ablation plume in the capillary; an electrospray apparatus to generate an electrospray plume to intercept the ablation plume to produce ions; and a mass spectrometer having an ion transfer inlet to capture the ions. The ablation plume may comprise a collimated ablation plume. The device may comprise a flow cytometer. Methods of making and using the same are also described.

20 Claims, 17 Drawing Sheets

(56) References Cited

U.S. PATENT DOCUMENTS 5,338,930 A 8/1994 Chu et al.
5,940,177 A 8/1999 Esser et al.
5,965,884 A 10/1999 Laiko et al.
6,111,251 A 8/2000 Hellenkamp
6,147,347 A * 11/2000 Hirabayashi et al. ..... 250/288
6,210,976 B1 4/2001 Sabbadini
6,495,824 B1 12/2002 Atkinson
6,531,318 B1 3/2003 Palmer-Toy et al.
6,548,263 B1 4/2003 Kapur et al.
6,558,946 B1 5/2003 Krishnamurthy
6,656,690 B2 12/2003 Crooke et al.
6,744,046 B2 6/2004 Valaskovic et al.
6,941,033 B2 9/2005 Taylor et al.
6,942,778 B1 9/2005 Jalali et al.
6,949,741 B2 9/2005 Cody et al.
6,989,528 B2 1/2006 Schultz et al.
6,991,903 B2 1/2006 Fu et al.
7,081,347 B2 7/2006 Yusuf et al.
7,084,396 B2 8/2006 Schneider
7,091,483 B2 8/2006 Fischer et al.
7,112,785 B2 9/2006 Laramee et al.
7,129,483 B2 10/2006 Youngquist et al.
7,170,052 B2 1/2007 Furutani et al.
7,192,779 B1 3/2007 Schackleton
7,271,397 B2 9/2007 Bryden et al.
7,335,897 B2 2/2008 Takats et al.
7,345,275 B2 3/2008 Amirav et al.
7,525,105 B2 4/2009 Kovtoun
7,577,538 B2 8/2009 Wang
7,629,576 B2 12/2009 Schultz et al.
7,684,934 B2 3/2010 Shvartsburg et al.
7,687,772 B2 3/2010 Shiea et al.
7,696,475 B2 4/2010 Shiea et al.
7,714,276 B2 5/2010 Pevsner et al.
7,718,958 B2 * 5/2010 Shiea ..... H01J 49/164 250/281
7,735,146 B2 6/2010 Vertes et al.
7,783,429 B2 8/2010 Walden et al.
7,901,682 B2 3/2011 Sabbadini
7,964,843 B2 6/2011 Vertes et al.
8,030,348 B2 10/2011 Sampalis
8,067,730 B2 11/2011 Vertes et al.
8,084,734 B2 12/2011 Vertes et al.
8,299,429 B2 10/2012 Vertes et al.
8,829,426 B2 * 9/2014 Vertes et al. ..... 250/282
2002/0190203 A1 12/2002 Valaskovic et al.
2003/0000838 A1 1/2003 Yeung et al.
2003/0180801 A1 9/2003 Maekawa et al.
2004/0051037 A1 * 3/2004 Taylor et al. ..... 250/288
2004/0121316 A1 6/2004 Birkus et al.
2004/0234971 A1 11/2004 Jackman
2005/0029444 A1 2/2005 Caprioli
2005/0035284 A1 2/2005 Schultz et al.
2005/0035285 A1 2/2005 Tan et al.
2005/0056776 A1 * 3/2005 Willoughby ..... H01J 49/164 250/288
2005/0061967 A1 3/2005 Shvartsburg et al.
2005/0199823 A1 9/2005 Franzen
2005/0230635 A1 10/2005 Takats et al.
2005/0247871 A1 11/2005 Bryden et al.
2006/0035284 A1 2/2006 Granoff et al.
2006/0105392 A1 5/2006 Lehmann et al.
2006/0190183 A1 8/2006 Walden et al.
2006/0217911 A1 9/2006 Wang
2006/0269964 A1 11/2006 Chait et al.
2006/0284068 A1 12/2006 Amirav et al.
2007/0114375 A1 5/2007 Pevsner et al.
2007/0176113 A1 8/2007 Shiea et al.
2007/0212348 A1 9/2007 Sabbadini
2007/0248947 A1 10/2007 Cezar
2008/0020474 A1 1/2008 Hayashizaki et al.
2008/0054176 A1 3/2008 Hiraoka
2008/0116366 A1 5/2008 Shiea et al.
2008/0124404 A1 5/2008 Liu et al.
2008/0128614 A1 6/2008 Nikolaev et al.
2008/0149822 A1 6/2008 Vertes et al.
2008/0220422 A1 9/2008 Shoemaker et al.
2008/0272294 A1 11/2008 Kovtoun
2008/0308722 A1 12/2008 Shiea
2009/0027892 A1 1/2009 Bremerich et al.
2009/0042304 A1 2/2009 Anderson et al.
2009/0261243 A1 10/2009 Bamberger et al.
2009/0272892 A1 * 11/2009 Vertes ..... H01J 49/0463 250/282
2009/0272893 A1 11/2009 Hieftje et al.
2009/0321626 A1 12/2009 Vertes et al.
2010/0012831 A1 1/2010 Vertes et al.
2010/0089529 A1 4/2010 Barholm-Hansen et al.
2010/0090101 A1 4/2010 Schultz et al.
2010/0090105 A1 4/2010 Liang et al.
2010/0252435 A1 10/2010 Weber
2010/0285446 A1 11/2010 Vertes et al.
2011/0133069 A1 * 6/2011 Holmquist et al. ..... 250/282
2011/0204220 A1 8/2011 van Wuijckhuijse et al.
2011/0215233 A1 9/2011 Vertes et al.
2011/0272572 A1 11/2011 Vertes et al.
2012/0025069 A1 2/2012 Vertes et al.
2012/0149009 A1 * 6/2012 Levis ..... H01J 49/0004 435/5
2012/0298857 A1 11/2012 Vertes et al.

FOREIGN PATENT DOCUMENTS

WO 9632504 A2 10/1996
WO 9945150 A1 9/1999
WO 0052455 A1 9/2000
WO 0077821 A2 12/2000
WO 0125486 A1 4/2001
WO 02055189 A2 7/2002
WO 02070664 A2 9/2002
WO 02071066 A1 9/2002
WO 02095362 A2 11/2002
WO 03081205 A2 10/2003
WO 03093817 A2 11/2003
WO 03100035 A2 12/2003
WO 2004013602 A2 2/2004
WO 2004044554 A2 5/2004
WO 2004044555 A2 5/2004
WO 2004076612 A2 9/2004
WO 2004088271 A2 10/2004
WO 2004097427 A1 11/2004
WO 2005024046 A2 3/2005
WO 2005031304 A2 4/2005
WO 2005033271 A2 4/2005
WO 2006014984 A1 2/2006
WO 2006026020 A2 3/2006
WO 2006048642 A2 5/2006
WO 2006054101 A2 5/2006
WO 2006059123 A2 6/2006
WO 2006061593 A2 6/2006
WO 2006061625 A2 6/2006
WO 2006064274 A2 6/2006
WO 2006064280 A2 6/2006
WO 2006067495 A2 6/2006
WO 2006023398 A2 8/2006
WO 2006085110 A2 8/2006
WO 2006129094 A2 12/2006
WO 2007052025 A2 5/2007

OTHER PUBLICATIONS

Coon J. and Harrison W., "Laser Desorption—Atmospheric Pressure Chemical Ionization Mass Spectrometry for the Analysis of Peptides from Aqueous Solution," Analytical Chemistry, Nov. 1, 2002, vol. 74, No. 21, pp. 5600-5605.

Rasmussen et al., "New Dimension in Nano-Imaging: Breaking Through the Diffraction Limit with Scanning Near-Field Optical Microscopy," Anal Bioanal. Chem., 2005, vol. 381, pp. 165-172.

Huang et al., "Direct Protein Detection from Biological Media through Electrospray-Assisted Laser Desorption Ionization/Mass Spectrometry," Journal of Proteome Research, vol. 5, No. 5, 2006, pp. 1107-1116.

Takats et al., "Mass Spectrometry Sampling Under Ambient Conditions with Desorption Electrospray Ionization," Science Magazine, vol. 306, Oct. 15, 2014, pp. 471-473.

(56) References Cited

OTHER PUBLICATIONS

Cody et al., "Versatile New Ion Source for the Analysis of Materials in Open Air under Ambient Conditions," Analytical Chemistry, vol. 77, No. 8, Apr. 15, 2005, pp. 2297-2302.
Nemes, Peter and Akos Vertes, "Laser Ablation Electrospray Ionization for Atmospheric Pressure, in Vivo and Imaging Mass Spectrometry," Analytical Chemistry, Nov. 1, 2007, vol. 79, No. 21, American Chemical Society, published on Web Sep. 27, 2007, pp. 8098-8106.
Moffit et al., Recent Advances in Optical Tweezers, Annual Review of Biochemistry, 2008, vol. 77, 205-228.
Nemes et al., "Simultaneous Imaging of Small Metabolites and Lipids in Rat Brain Tissues at Atmospheric Pressure by Laser Ablation Electrospray Ionization Mass Spectrometry," Analytical Chemistry, vol. 82, No. 3, Feb. 1, 2010, pp. 982-988.
Shrestha, Bindesh and Akos Vertes, "In Situ Metabolic Profiling of Single Cells by Laser Ablation Electrospray Ionization Mass Spectrometry," Analytical Chemistry, vol. 81, No. 20, Oct. 15, 2009, pp. 8265-8271.
Sampson et al., "Intact and Top-Down Characterization of Biomolecules and Direct Analysis Using Infrared Matrix-Assisted Laser Desorption Electrospray Ionization Coupled to FT-ICR Mass Spectrometry," Journal of the American Society for Mass Spectrometry 2009, vol. 20, pp. 667-673.
Rezenom, et al., "Infrared laser-assisted desorption electrospray ionization mass spectrometry," The Analyst, 2008, vol. 133, pp. 226-232.
Shrestha, Bindesh and Akos Vertes, "Ablation and analysis of small cell populations and single cells by consecutive laser pulses," Applied Physics A, presented at the 10th International Conference on Laser Ablation, 2009, Singapore, published online Jun. 3, 2010, 6 pages.
Edwards et al., "Free-electron-laser-based biophysical and biomedical instrumentation," Review of Scientific Instruments, vol. 74, No. 7, Jul. 2003, pp. 3207-3245.
Boskey, Adele and N. Camacho, "FT-IR Imaging of Native and Tissue-Engineered Bone and Cartilage," Biomaterials, May 2007, 28(15), pp. 2465-2478.
Cramer et al., "Matrix-assisted laser desorption and ionization in the O-H and C=O absorption bands of aliphatic and aromatic matrices: dependence on laser wavelength and temporal beam profile," International Journal of Mass Spectrometry and Ion Processes, 169/170, 1997, pp. 51-67.
"Generation of three-dimensional images in mass spectrometry," Technology Access offered by Hessische Intellectual Property Offensive, TransMIT Society for Technology Transfer Department of Patents and Innovations, May 16, 2003, printed from http://www.hipo-online.de/files/Exp_Hipo_3D_MS_EN_160503.pdf, 2 pages.
Nemes et al., "Three-Dimensional Imaging of Metabolites in Tissues under Ambient Conditions by Laser Ablation Electrospray Ionization Mass Spectrometry," Analytical Chemistry, Aug. 15, 2009, vol. 81, No. 16, pp. 6668-6675.
Nemes et al., "Ambient Molecular Imaging and Depth Profiling of Live Tissue by Infrared Laser Ablation Electrospray Ionization Mass Spectrometry," Analytical Chemistry, Jun. 15, 2008, vol. 80, No. 12, pp. 4575-4582.
Vaikkinen et al., "Infrared Laser Ablation Atmospheric Pressure Photoionization Mass Spectrometry," Analytical Chemistry, 2012, 84, 1630-1636.
Meyerhoff et al., "Elevated subcortical choline metabolites in cognitively and clinically asymptomatic HIV patients," Neurology, Mar. 1, 1999, vol. 52, No. 5, 995, 3 pages.
Rhodes et al., "Metabolic Abnormalities Associated with Diabetes Mellitus, as Investigated by Gas Chromotography and Pattern-Recognition Analysis of Profiles of Volitile Metabolites," Clinical Chemistry, vol. 27, No. 4, 1981, pp. 580-585.
Brand, Willi A., "Special Feature: Historical, High Precision Isotope Ratio Monitoring Techniques in Mass Spectrometry," Journal of Mass Spectrometry, 1996, vol. 31, pp. 225-235.
U.S. Appl. No. 13/794,851, filed Mar. 12, 2013.
Jentaie et al., "Electrospray-assisted Laser Desportion/Ionization Mass Spectrometry for Direct Ambient Analysis of Solids", Rapid Communications in Mass Spectrometry, John Wiley & Sons, Great Britain, Jan. 1, 2005, vol. 19, issue 24, pp. 3701-3704.
Editorial—"Extending Opportunities", Nature Photonics, Jul. 1, 2012, vol. 6, No. 7, p. 407.
Anonymous, "Infrared", Wikipedia, the Free Encyclopedia, Jul. 13, 2011, http://en.wikipedia.org/w/index.php?title=Infrared&oldid=439203995, pp. 2-5, paragraph "Different regions in the Infrared".
Nemes et al., "Laser Ablation Electrospray Ionization for Atmosphreric Pressure, in Vivo and Imaging Mass Spectrometry", Analytical Chemistry, Nov. 1, 2007, vol. 79, pp. 8-098-8106.
Stolee et al., "Toward Single-Cell Analysis by Plume Collimation in Laser Ablation Electrospray Ionization Mass Spectrometry", Analytical Chemistry, Apr. 2, 2013, vol. 85, No. 7, pp. 3592-3598.
European Search Report and Written Opinion for EP Application No. 12855021.7, Applicant,The George Washington University, Apr. 28, 2015.

* cited by examiner

OD = capillary outer diameter
ID = capillary inner diameter
L = capillary length
d = capillary end-to-liquid distance
$d_i$ = fiber tip insertion depth
V = liquid volume
C = cell
CD = optical fiber core diameter
R = fiber tip radius of curvature FIG. 13 - Capillary Length (L) on Bradykinin Signal ID= 2 mm 5uL brad_H tube 6mm_E90 rep 10 .3uLmin 50% meoh_3000V FIG. 14 - Inner Diameter (ID) of the Capillary on Bradykinin Signal FIG. 15 - Ablation of Human Cheek Cells Suspended in a Droplet FIG. 16 - Ablation of Epithelial Beta Cells Suspended in a Droplet

PLUME COLLIMATION FOR LASER ABLATION ELECTROSPRAY IONIZATION MASS SPECTROMETRY

CROSS-REFERENCE TO RELATED APPLICATIONS

This application is a continuation of U.S. application Ser. No. 13/549,988, filed on Jul. 16, 2012, which claims the benefit of U.S. Provisional Application No. 61/507,836, filed on Jul. 14, 2011. Each of the foregoing applications is incorporated herein by reference in its entirety.

STATEMENT OF GOVERNMENTAL INTEREST

This invention was made with Government support under Grant No. 0719232 awarded by the National Science Foundation and Grant No. DEFG02-01ER15129 awarded by the U.S. Department of Energy. The government has certain rights in the invention

BACKGROUND

The apparatuses and methods described herein generally relate to ionization sources for mass spectrometers and methods of mass spectrometry, and in particular, laser ablation electrospray ionization (LAESI) mass spectrometry (MS), as well as methods of making and using the same.

Mass spectrometry is an analytical technique that has been successfully used in chemistry, biology, medicine, and other fields for qualitative and quantitative analysis. The analysis of a single cell and/or subcellular component by conventional methods of mass spectrometry typically requires extensive sample preparation which may alter the molecular composition of the system. For example, matrix-assisted laser desorption ionization (MALDI) combined with laser capture microdissection may suffer from time consuming and complex sample preparation, e.g., to freeze or fix the sample, which may cause perturbations to the biological sample. MALDI also utilizes a matrix that may interfere with the analysis of single cells and subcellular components. Live video mass spectrometry and direct organelle mass spectrometry use organic solvents that may also interfere with the analysis of single cells and subcellular components. Mass spectrometry may be combined with conventional separation techniques, such as capillary electrophoresis, however, these techniques may increase analysis time, complexity and/or cost.

Accordingly, more efficient and/or cost-effective mass spectrometry devices and methods of making and using the same are desirable.

DESCRIPTION OF THE DRAWINGS

The various embodiments described herein may be better understood by considering the following description in conjunction with the accompanying drawings.

FIG. 15A includes a representative mass spectrum of 20 squamous epithelial cells. FIG. 15B includes a representative mass spectrum of 10 squamous epithelial cells. FIG. 15C includes a representative mass spectrum of 6 squamous epithelial cells. FIG. 15D includes a representative mass spectrum of 4 squamous epithelial cells.

DESCRIPTION OF CERTAIN EMBODIMENTS

Figure 1B:
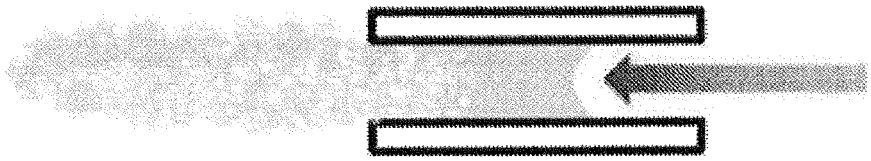
FIG. 1B includes a schematic of a collimated ablation plume according to various embodiments described herein.

As generally used herein, the articles "one", "a", "an" and "the" refer to "at least one" or "one or more", unless otherwise indicated.

As generally used herein, the terms "including" and "having" mean "comprising".

As generally used herein, the term "about" refers to an acceptable degree of error for the quantity measured, given the nature or precision of the measurements. Typical exemplary degrees of error may be within 20%, 10%, or 5% of a given value or range of values. Alternatively, and particularly in biological systems, the terms "about" refers to values within an order of magnitude, potentially within 5-fold or 2-fold of a given value.

All numerical quantities stated herein are approximate unless stated otherwise. Accordingly, the term "about" may be inferred when not expressly stated. The numerical quantities disclosed herein are to be understood as not being strictly limited to the exact numerical values recited. Instead, unless stated otherwise, each numerical value is intended to mean both the recited value and a functionally equivalent range surrounding that value. At the very least, and not as an attempt to limit the application of the doctrine of equivalents to the scope of the claims, each numerical parameter should at least be construed in light of the number of reported significant digits and by applying ordinary rounding techniques. Notwithstanding the approximations of numerical quantities stated herein, the numerical quantities described in specific examples of actual measured values are reported as precisely as possible.

Any numerical range recited in this specification is intended to include all sub-ranges of the same numerical precision subsumed within the recited range. For example, a range of "1.0 to 10.0" is intended to include all sub-ranges between (and including) the recited minimum value of 1.0 and the recited maximum value of 10.0, that is, having a minimum value equal to or greater than 1.0 and a maximum value equal to or less than 10.0, such as, for example, 2.4 to 7.6. Any maximum numerical limitation recited in this disclosure is intended to include all lower numerical limitations subsumed therein and any minimum numerical limitation recited in this disclosure is intended to include all higher numerical limitations subsumed therein. Accordingly, Applicants reserve the right to amend this specification, including the claims, to expressly recite any sub-range subsumed within the ranges expressly recited herein.

In the following description, certain details are set forth in order to provide a better understanding of various embodiments of ionization sources for mass spectrometers and methods for making and using the same. However, one skilled in the art will understand that these embodiments may be practiced without these details and/or in the absence of any details not described herein. In other instances, well-known structures, methods, and/or techniques associated with methods of practicing the various embodiments may not be shown or described in detail to avoid unnecessarily obscuring descriptions of other details of the various embodiments.

This disclosure describes various features, aspects, and advantages of various embodiments of ionization sources for mass spectrometers and methods for making and using the same. It is understood, however, that this disclosure embraces numerous alternative embodiments that may be accomplished by combining any of the various features, aspects, and advantages of the various embodiments described herein in any combination or sub-combination that one of ordinary skill in the art may find useful. Such combinations or sub-combinations are intended to be included within the scope of this specification. As such, the claims may be amended to recite any features or aspects expressly or inherently described in, or otherwise expressly or inherently supported by, the present disclosure. Further, Applicants reserve the right to amend the claims to affirmatively disclaim any features or aspects that may be present in the prior art. The various embodiments disclosed and described in this disclosure may comprise, consist of, or consist essentially of the features and aspects as variously described herein.

According to certain embodiments, more efficient and/or cost-effective mass spectrometry devices and methods of making and using the same are described.

Metabolism generally refers to chemical processes of a living cell or organism that support and maintain life. The products of these chemical processes may be generally referred to as metabolites. The metabolites and distribution of metabolites in a cell or tissue may change depending on its function, biological state, developmental stage, history, and/or environment. Identification and analysis of metabolites and metabolite distributions may facilitate a better understanding of cell function. Certain embodiments may be used to analyze cellular heterogeneity and provide insight into the cell-to-cell variations of metabolic pathways affected by diseases.

Mass spectrometric analysis of subcellular components, single cells, and/or groups of cells may be limited by small sample volumes and/or inefficient ion production. A small sample volume may coexist with a low concentration of subcellular components in a single cell or group of cells. Some conventional techniques to isolate single cells and/or groups of cells may cause sampling-related perturbations that disrupt metabolite distributions within the sample. Therefore, mass spectrometry devices and methods of using the same having improved ion efficiency and/or sensitivity and/or limits of detection are desirable.

Figure 1A:
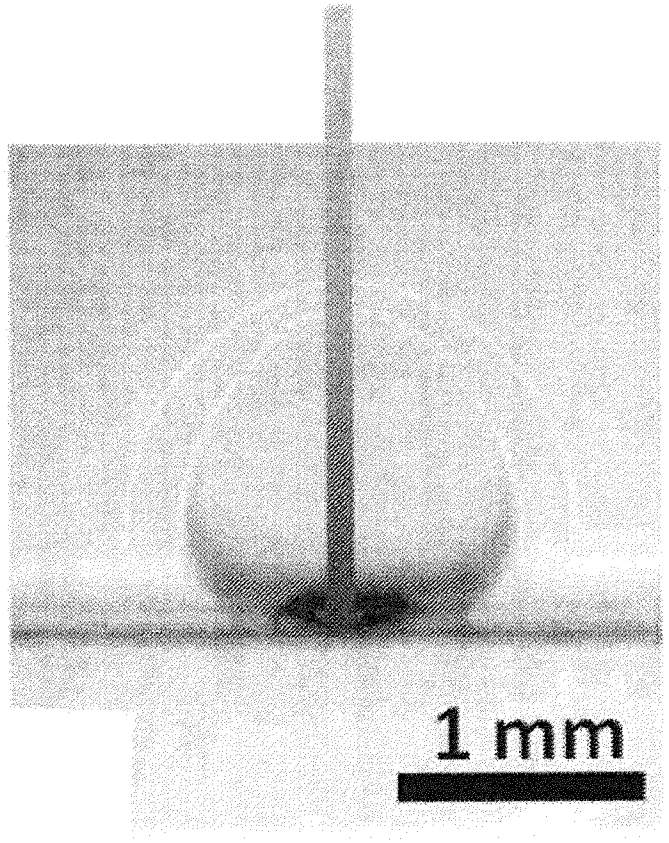
FIG. 1A includes an image of a freely expanding hemispherical ablation plume generated by the mid-infrared ablation of water in the ambient environment.

Some mass spectrometry techniques may comprise a freely expanding ablation plume, such as a hemispherical laser ablation plume illustrated in FIG. 1A, characterized by low ionization efficiency and/or low sensitivity and/or low limits of detection. A freely expanding ablation plume in the ambient environment may be generated, for example, when mid-infrared laser pulses at a wavelength of about 2.94 μm and a pulse length of about 5 nanoseconds are emitted at a sample comprising water. The absorption of the laser energy by the water may initiate surface evaporation, shock-wave emission, and/or ejection of droplets via phase explosion. The surface evaporation may initiate relatively slow plume expansion that, after about 300 ns, induces a propagation of shock waves, which may not be very efficient. However, at the spinodal limit, i.e., when the sample is superheated to about its critical temperature, a rapidly expanding vapor plume, droplets, and/or particulates may be ejected. Without wishing to be bound to any particular theory, it is believed that the spinodal limit may be achieved when the volumetric energy density, $\epsilon$ ($\epsilon=\mu F$, where F is the laser fluence and $\mu$ is the absorption coefficient), is greater than about 1 kJ/cm$^3$ or when the laser energy increases the temperature of the liquid to about 80% of its critical temperature. After about 1 μs, the phase explosion may induce recoil pressure that generates an efficient secondary material ejection process.

According to certain embodiments, mass spectrometry devices and methods of making and using the same may be characterized by improved ionization efficiency and/or improved sensitivity and/or improved limits of detection relative to a freely expanding ablation plume. As described herein, laser ablation may be used to eject a small volume from a sample in a collimated ablation plume to improve ion production, and thereby ionization efficiency and/or limits of detection. In various embodiments, mass spectrometry devices and methods of making and using the same may comprise direct mass spectrometry devices and methods of making and using the same for in vivo analysis of small cell populations, single cells and/or subcellular components. In various embodiments, a biological sample may be analyzed in a native environment with minimal and/or no sample preparation.

In various embodiments, mass spectrometry devices may comprise a capillary or hollow waveguide to select a sample for ablation and/or collimate the ablation plume. For example, a capillary may be inserted into an aqueous droplet comprising cells to select one or more cells for ablation. The cell may be drawn into the capillary by capillary forces. The mass spectrometry device may comprise ablation in transmission geometry. As shown in FIG. 1B, a capillary may collimate an ablation plume generated in the capillary. In various embodiments, the ablation plume may comprise a collimated ablation plume. The collimated ablation plume may comprise a radially confined ablation plume. The collimated ablation plume may comprise a collinear ablation plume. The capillary may reduce and/or eliminate the radial expansion of the ablation plume. The collimated ablation plume may be ejected from the capillary. The collimated ablation plume may generate a more efficient ionization process.

A collimated ablation plume in the ambient environment may be generated, for example, when mid-infrared laser pulses at a wavelength of about 2.94 μm and a pulse length of about 5 nanoseconds are emitted at a sample comprising water within a capillary. The radial expansion of the ablation plume may be reduced and/or eliminated by the capillary. Without wishing to be bound to any particular theory, the collimated ablation plume may exhibit different photomechanical effects, plume dynamics, and/or kinetics relative to the freely expanding ablation plume. For example, the collimated ablation plume may achieve greater pressures and/or greater temperatures than the freely expanding ablation plume. Further, when an optical fiber is used to couple the laser energy to the sample, the optical fiber tip may generate acoustic radiation that causes greater tensile stress in the water, and may generate explosive vaporization of the water, cavitation of the water, and/or bubble formation. The collapse of the generated bubble may generate the ejection of the ablation plume in a high speed liquid jet. The capillary may generate more efficient plume collimation and acceleration. The radial confinement of the ablation plume in the capillary may generate increased pressures in the capillary, resulting in forward directed propulsion of a collimated ablation plume. The collimated ablation plume may improve ion formation and/or ion efficiency.

Certain embodiments of the LAESI ionization sources for mass spectrometers and methods of making and using the same described herein may provide certain advantages over other approaches of mass spectrometric analysis. The advantages may include one or more of, but are not limited to, in situ analysis, in situ single cell analysis, in situ subcellular analysis, in vivo analysis, in vivo single cell analysis, in vivo subcellular analysis, simultaneous detection of multiple components in samples, independent optimization of ablation conditions and ionization conditions, a wider dynamic range of samples that may be used, quantitative analysis, semi-quantitative analysis, operation under ambient conditions, simpler sample preparation, minimal sample manipulation, minimal sample degradation, direct analysis of tissues and cells, analysis of large samples, two-dimensional mass spectrometric imaging at atmospheric pressure, three-dimensional mass spectrometric imaging at atmospheric pressure, the ability to monitor environmental effects or external stimuli on multiple cells, single cells, or subcellular components, the ability to monitor the effects of xenobiotics, for example, pharmaceuticals, drug candidates, toxins, environmental pollutants, and/or nanoparticles, the ability to couple with a flow cytometry system, higher throughput, improved sampling time, positional sensitivity, improved sensitivity, improved sensitivity to surface properties, improved ionization, improved ionization efficiency, and improved detection limits.

Laser ablation electrospray ionization mass spectrometry may be generally described in the following U.S. patents and U.S. patent applications: U.S. Pat. No. 7,964,843, entitled "Three-dimensional molecular imaging by infrared laser ablation electrospray ionization mass spectrometry", which issued on Jun. 21, 2011; U.S. Pat. No. 8,067,730, entitled "Laser Ablation Electrospray Ionization (LAESI) for Atmospheric Pressure, In Vivo, and Imaging Mass Spectrometry", which issued on Nov. 29, 2011; and U.S. Patent Application Publication No. 2010/0285446 entitled "Methods for Detecting Metabolic States by Laser Ablation Electrospray Ionization Mass Spectrometry", which was filed on May 11, 2010.

In various embodiments, a device may generally comprise a capillary having a first end and a second end, a laser system to emit energy at a sample in the capillary to ablate the sample and generate an ablation plume in the capillary, an electrospray apparatus to generate an electrospray plume to intercept the ablation plume to produce ions, and a mass spectrometer system. At least one of the first end and second end may comprise an open end. In certain embodiments, the first end may comprise an open end and the second end may comprise an open end. In certain embodiments, the first end may comprise a closed end and the second end may comprise an open end. The mass spectrometer system may comprise a mass spectrometer having an ion transfer inlet to capture the ions, and a recording device, such as, for example, a personal computer. The electrospray plume may intercept the ablation plume when the ablation plume exits the second end of the capillary. The ablation plume may comprise a collimated ablation plume, such as, for example, a radially confined ablation plume and/or a collinear ablation plume. In certain embodiments, the capillary may comprise a glass capillary. In certain embodiments, the capillary may comprise a hollow waveguide.

The laser system may comprise a mid-infrared laser and a focusing system comprising fiber optics, coupling lenses, focusing lenses, and/or an optical fiber. The focusing system may deliver and/or couple the laser pulses to the sample. The electrospray apparatus may comprise an electrospray ionization emitter having a power supply and a syringe pump. The device may comprise a sample mount. The device may comprise a shroud to enclose the sample, the sample mount, and/or the electrospray emitter. The sample environment may be temperature controlled and/or atmosphere controlled. The atmosphere may comprise ambient pressure and temperature. The pressure may range from 0.1-5 atm, such as, for example, 0.5-5 atm, 1-5 atm, and 0.1-1 atm. The temperature may range from −10° C. to 60° C. The relative humidity may range from 10% to 90%.

Figure 2:
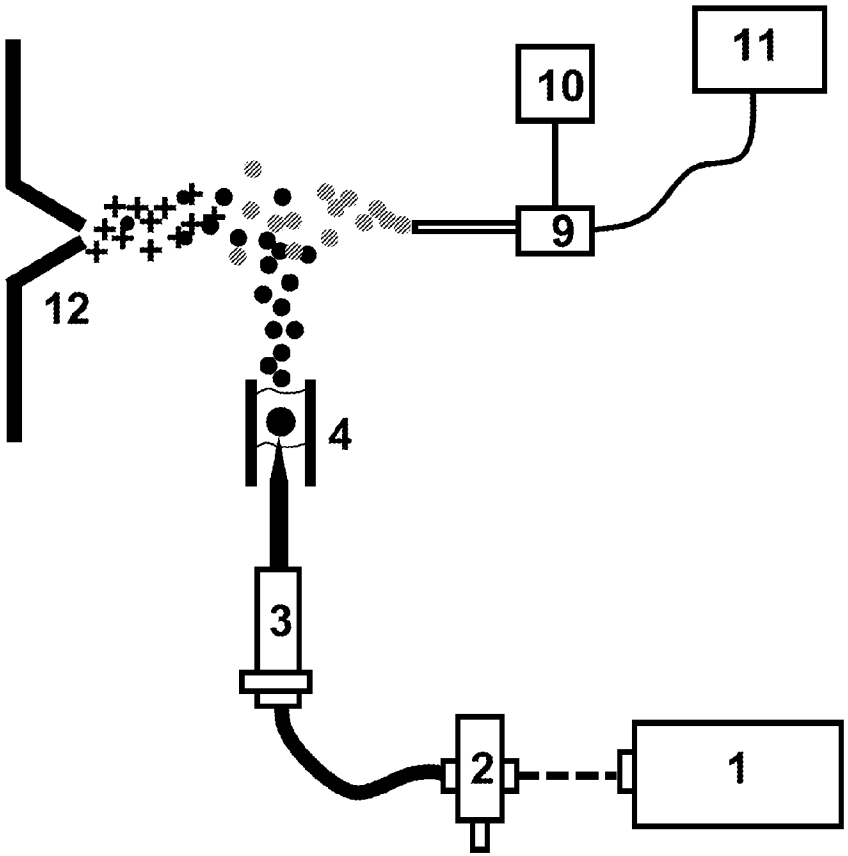
FIGS. 2-6 include illustrations of mass spectrometry systems according to various embodiments described herein.

In various embodiments, a device may comprise a capillary having a first end and a second end, a pulsed, mid-infrared laser to emit energy at a sample in the capillary to ablate the sample and generate an ablation plume in the capillary, an electrospray apparatus to generate an electrospray plume to intercept the ablation plume to produce positive or negative ions, and a mass spectrometer having an ion transfer inlet to capture the ions. Referring to FIG. 2, a device may comprise a laser 1, such as, for example, a pulsed, mid-infrared laser, a focusing device, e.g., a lens (not shown), a fiber mount 2, an optical fiber 3, a sample (●) contained in the capillary 4, an electrospray apparatus comprising an emitter 9, a high voltage power supply 10, a syringe pump 11, and a mass spectrometer 12. The laser may be one of an Er:YAG laser, a Nd:YAG laser driven optical parametric oscillator and a free electron laser. The capillary 4 may comprise at least a portion of the sample. The sample may be positioned intermediate a first end of the capillary 4 and a second end of the capillary 4. The sample may be positioned adjacent or proximate to the open end of the capillary 4. At least a portion of the sample may be positioned outside the capillary. The sample may be positioned intermediate the optical fiber 3 and the second end of the capillary 4. The laser 1 may be coupled to the first end of the capillary 4. The laser pulse may be delivered and/or coupled to the sample by the optical fiber 3. The device may comprise one or more actuators (not shown) to position the focusing device, capillary, electrospray emitter, and/or laser. The device may comprise a recording device (not shown).

In various embodiments, the electrospray plume (⁂) may intercept the ablation plume (●) to generation ions (+) detectable by the mass spectrometer 12. Depending on the polarity of the electrospray, the ions may be positive or negative. In at least one embodiments, the ions may comprise cations. As shown in FIG. 2, the electrospray plume (⁂) may travel in a forward direction from the emitter 9 toward the orifice of the mass spectrometer 12. The capillary 4 may be oriented toward the electrospray plume (⁂) The second end of the capillary may be oriented towards the electrospray plume (⁂). At least a portion of the ablation plume (●) may be generated in the capillary 4. The ablation plume (●) may be generated in the capillary 4. The ablation plume (●) may travel in a forward direction toward the second end of the capillary 4. The capillary 4 may radially confine the ablation plume (●). The ablation plume (●) may comprise a collimated ablation plume. The collimated ablation plume may comprise a radially confined ablation plume. The collimated ablation plume may comprise a collinear ablation plume. At least a portion of the ablation plume (●) may be ejected from the capillary 4. The ablation plume (●) may be ejected from the capillary 4. The ablation plume (●) may be ejected from the second end of the capillary towards the electrospray plume (⁂) The ejected ablation plume may be a collimated ablation plume. The electrospray plume (⁂) may intercept the ablation plume (●) to produce ions detectable by the mass spectrometer 12. Without wishing to be bound to any particular theory, the collimated ablation plume may improve ion formation and/or ionization efficiency.

Figure 3:
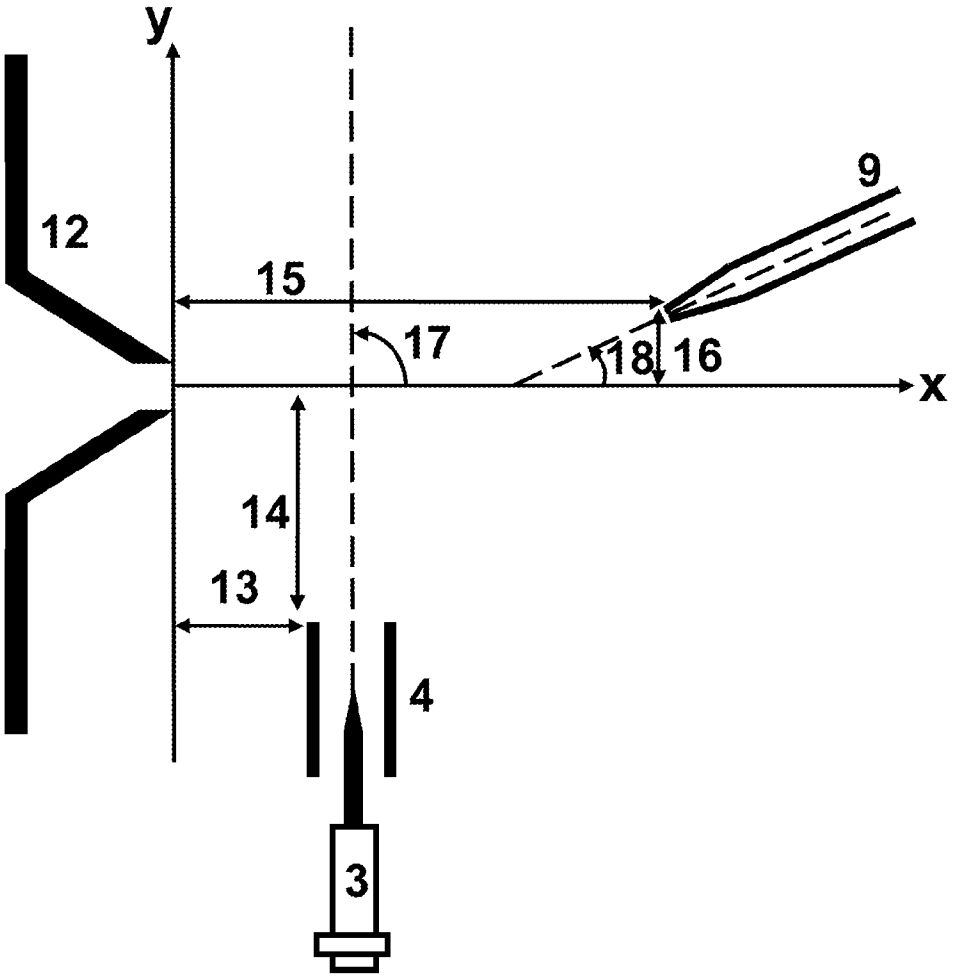
Figure 4:
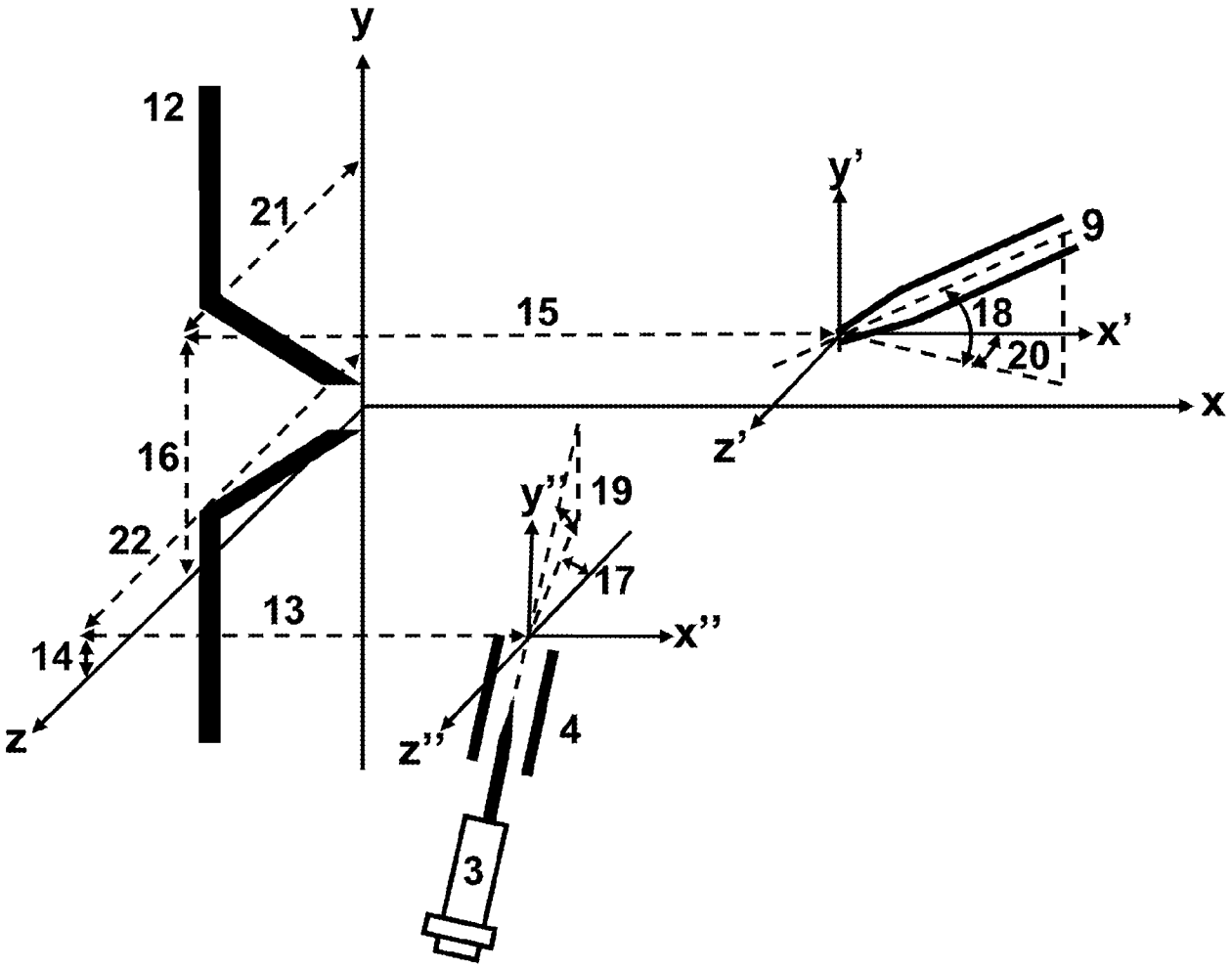

Referring to FIGS. 3 and 4, according to certain embodiments, the mass spectrometer 12 orifice may be on one of a same axis or a different axis as the electrospray emitter 9. The x-y-z axes may be orientated with respect to the mass spectrometer 12. The x'-y'-z' axes may be orientated with respect to the electrospray emitter 9. The x'-y'-z' axes may be parallel to the x-y-z axes, respectively. The x"-y"-z" axes may be parallel to the x-y-z axes, respectively. As shown in the FIG. 3, the mass spectrometer 12, electrospray emitter 9, and the second end of the capillary 4 may be in the same x-y plane. The distance 15 from the mass spectrometer 12 orifice to the electrospray emitter 9 tip along the x-axis may be from 1 mm to 20 mm, such as, for example, 5 mm to 15 mm, 5 mm, 10 mm, and 15 mm. In at least one embodiment, the distance 15 may be 12 mm. The distance 16 from the mass spectrometer 12 orifice to the electrospray emitter 9 tip along the y-axis may be from −20 mm to 20 mm, such as, for example, −10 mm, −5 mm, −1 mm, 0 mm, 1 mm, 5 mm, and 10 mm. The distance 21 from the mass spectrometer 12 orifice to the electrospray emitter 9 tip along the z-axis may be from −20 mm to 20 mm, such as, for example, −10 mm, −5 mm, −1 mm, 0 mm, 1 mm, 5 mm, and 10 mm. The angle 18 may be defined as the angle between the central axis of the mass spectrometer 12 orifice along the x-axis and the axis of the electrospray emitter 9, or more generally, as the angle between the axis of the electrospray emitter 9 and the x'-z' plane illustrated in FIG. 4. The angle 20 may be defined as the angle between the projection of the electrospray emitter 9 axis to the x'-z' plane and the x'-axis. Each of the angles 18 and 20 may be individually selected from −90° to 90°, such as, for example, −45° to 45°, −60°, −45°, −30°, −15°, 0°, 15°, 30°, 45°, 60°, and 90°.

Referring to FIGS. 3 and 4, according to certain embodiments, the distance 13 from the front of the mass spectrometer 12 orifice to the second end of the capillary 4 along the x-axis (the y-z plane illustrated in FIG. 4) may be 0-20 mm, such as, for example, 1 mm, 5 mm, 10 mm, and 15 mm. The distance 14 from the central axis of the mass spectrometer 12 orifice to the second end of the capillary 4 along the y-axis (the x-z plane illustrated in FIG. 4) may be from −20 mm to 20 mm, such as, for example, −10 mm, −1 mm, 0 mm, 1 mm, and 10 mm. The distance 22 from the mass spectrometer 12 orifice to the second end of the capillary 4 along the z-axis (the x-y plane illustrated in FIG. 4) may be from −20 mm to 20 mm, such as, for example, −10 mm, −1 mm, 0 mm, 1 mm, and 10 mm. The angle 17 may be defined as the angle between the projection of the capillary 4 axis to the x"-z" plane and the z"-axis illustrated in FIG. 4. The angle 19 may be defined as the angle between the axis of the capillary 4 and the x"-z" plane illustrated in FIG. 4. Each of the angles 17 and 19 may be individually selected from −90° to 90°, such as, for example, −45° to 45°, −90°, −60°, −45°, −30°, 0°, 30°, 45°, 60°, and 90°. In various embodiments, the second end of the capillary 4 may be 15 mm above or below the x-y plane. In at least one embodiment, the electrospray solution may be applied on axis with the mass spectrometer 12 orifice (angles 20 and 18=0° and distances 21 and 16=0 mm) In at least one embodiment, the electrospray solution may be applied at a right angle (90°) into the ablation plume.

In various embodiments, the distance 13 may be from 0 mm to 20 mm, such as, for example greater than 0 mm to 20 mm, and 4.5 mm, the distance 14 may be from −20 mm to 20 mm, such as, for example, −10 mm, the distance 15 may be from greater than 0 mm to 20 mm, such as, for example, 1 mm and 12 mm, the distance 16 may be from −20 mm to 20 mm, such as, for example, 0 mm, the distance 21 may be from −20 mm to 20 mm, such as, for example, 0 mm, and the distance 22 may be from −20 mm to 20 mm, such as, for example, 0 mm, and the angle 17 may be from −90° to 90°, such as, for example, 0°, the angle 18 may be from −90° to 90°, such as, for example, 0°, the angle 19 may be from −90° to 90°, such as, for example, 0°, and the angle 20 may be from −90° to 90°, such as, for example, 0°.

In various embodiments, a device may generally comprise a flow cytometer. In various embodiments, a device may comprise a flow cytometry system comprising a capillary, a laser system to emit energy at a sample in the capillary to ablate the sample and generate an ablation plume in the capillary, an electrospray apparatus to generate an electrospray plume to intercept the ablation plume to produce ions, and a mass spectrometer system. The flow cytometry system may comprise a flow cytometer. The flow cytometry system may comprise a flow through capillary having an open end and an opposite end, and optionally, a waste container positioned adjacent the open end of the capillary. The opposite end of the capillary may comprise a closed end. The mass spectrometer system may comprise a mass spectrometer having an ion transfer inlet to capture the ions, and a recording device, such as, for example, a personal computer. The laser system may comprise a mid-infrared laser and a focusing system comprising fiber optics, coupling lenses, and/or focusing lenses. The device may comprise an optical fiber to deliver and/or couple the laser pulses to the sample. The electrospray apparatus may comprise an electrospray ionization emitter having a power supply and a syringe pump. The device may comprise a sample mount. The device may comprise a shroud to enclose the sample, the sample mount, and/or the electrospray emitter.

The flow cytometry system may hydrodynamically focus a sample in a stream of fluid. For example, the flow through capillary may hydrodynamically focus a group of cells into a single stream of cells. The device may comprise a flow cytometer to hydrodynamically focus a sample in a stream of fluid. The device may comprise a focusing system to deliver and/or couple the laser pulse to the sample when the sample is at a point of ablation in the capillary. The ablation plume may travel in a forward direction toward the open end of the capillary. The capillary may radially confine the ablation plume. The ablation plume may comprise a collimated ablation plume. The capillary may be oriented toward the electrospray plume. The ablation plume may be ejected from the capillary toward the electrospray plume. The ablation plume may be intercepted by an electrospray plume and ionized to generate ions detectable by the mass spectrometer.

In various embodiments, the flow cytometry system may comprise a continuous laser, such as, for example, an argon ion laser and a helium-neon (HeNe) laser, positioned on a first side of the flow through capillary, and a detector, such as, for example, a photodetector and a fluorescence detector, positioned on a second side of the flow through capillary, and a delay generator in electrical communication with the detector and mid-infrared laser. The continuous laser may be positioned upstream from the mid-infrared laser. The continuous laser may irradiate the flow through capillary with a continuous laser beam. The continuous laser beam may be deflected or scattered by the sample when the sample passes the continuous laser beam. The detector may detect the deflected or scattered laser beam and activate the delay generator. The delay generator may activate the mid-infrared laser when the sample is at a point of ablation in the capillary. The delay generator may be configured to delay activation of the mid-infrared laser until the sample is at a point of ablation in the capillary. The duration of the delay may be the time for the sample to travel from the point when the cell intercepts the continuous laser beam to the point of ablation. In various embodiments, the sample may comprise a fluorescent tag, such as, for example, a green fluorescent protein, a yellow fluorescent protein, an immunofluorescent tag, and an acridine orange dye.

Figure 5:
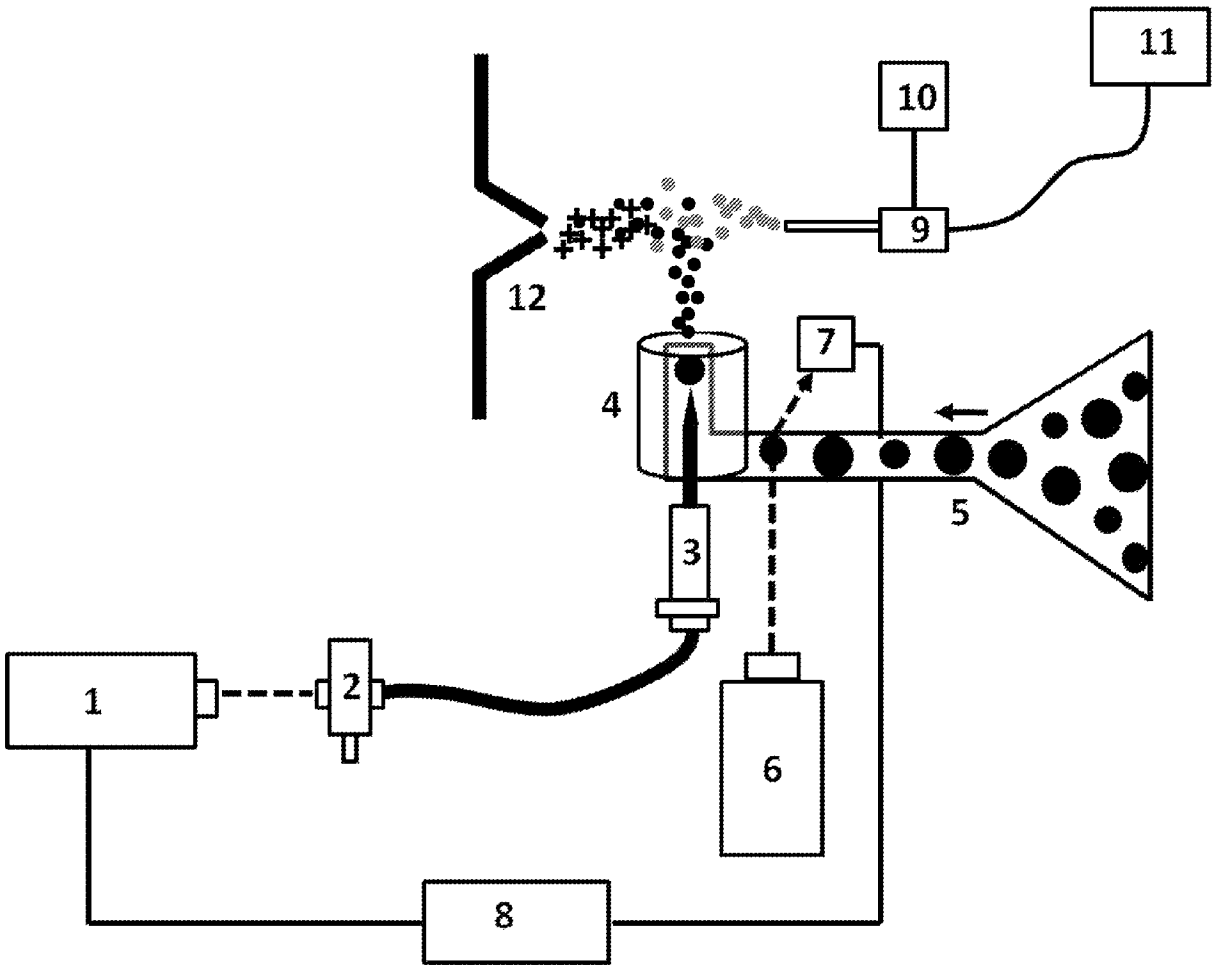

Referring to FIG. 5, in certain embodiments, a mass spectrometer device may comprise a mid-infrared laser 1, such as, for example, a Nd:YAG laser driven optical parametric oscillator, a focusing system comprising an optical fiber 3 held on one end by a fiber mount 2, a waste container 4, a capillary 5, a continuous laser 6, a detector 7, a delay generator 8 in electrical communication with the detector 7 and mid-infrared laser 1, an electrospray apparatus including an electrospray emitter 9, a syringe pump 11, a high voltage power supply 10, and a mass spectrometer 12. The focusing system may focus the laser pulse inside the capillary 5 to deliver the laser energy to the sample (●). The device may comprise one or more actuators (not shown) to position the focusing system, capillary, electrospray emitter, and/or lasers. The device may comprise a recording device (not shown).

Figure 6:
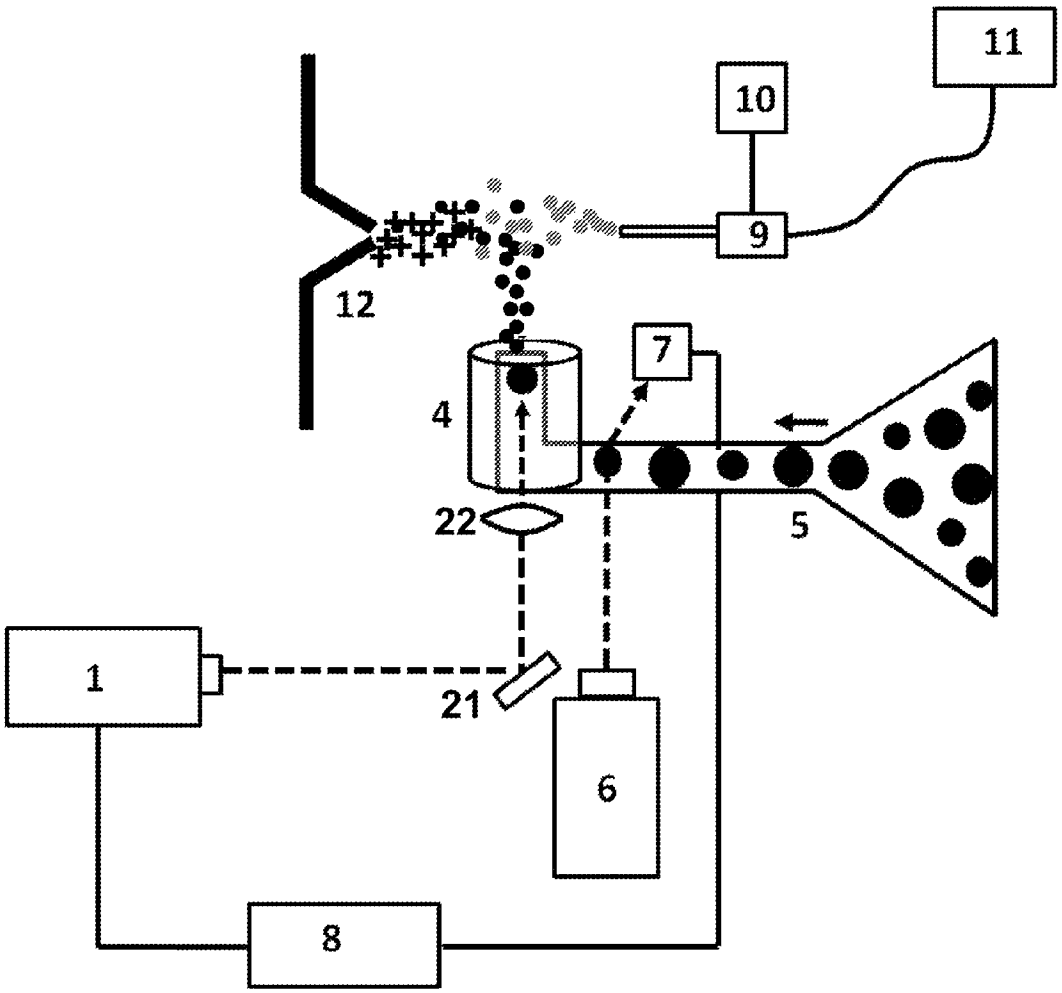

Referring to FIG. 6, in certain embodiments, a mass spectrometer device may comprise a mid-infrared laser 1, such as, for example, a Nd:YAG laser driven optical parametric oscillator, a focusing system comprising a beam steering device 21, such as, for example, a mirror, and a focusing device 22, such as, for example, a lens, a waste container 4, a capillary 5, a continuous laser 6, a detector 7, a delay generator 8 in electrical communication with the detector 7 and mid-infrared laser 1, an electrospray apparatus including an electrospray emitter 9, a syringe pump 11, a high voltage power supply 10, and a mass spectrometer 12. The focusing system may focus the laser pulse inside the capillary 5 to deliver the laser energy to the sample (●). The device may comprise one or more actuators (not shown) to position the focusing system, capillary, electrospray emitter, and/or lasers. The device may comprise a recording device (not shown).

Regarding FIGS. 5 and 6, the point of ablation may be intermediate the open end of the capillary 5 and the point when the sample passes the continuous laser beam. The point of ablation may be directly adjacent to the open end of the capillary 5. The ablation plume may be generated in the capillary 5. The ablation plume may travel in a forward direction toward the open end of the capillary 5. The capillary 5 may radially confine the ablation plume. The ablation plume may comprise a collimated ablation plume. The capillary 5 may be oriented toward the electrospray plume. The ablation plume may be ejected from the capillary 5 toward the electrospray plume. The ablation plume may be intercepted by an electrospray plume and ionized to generate ions detectable by the mass spectrometer 12.

In various embodiments, the laser pulse may have a wavelength of 100 nm to 8 μm, a diameter of 0.5-20 mm before focusing, a pulse length of less than one picosecond to 100 ns, and a repetition rate of up to 100 MHz, such as, for example, 0.1 Hz to 100 MHz, under ambient conditions. In various embodiments, the laser pulse may have a wavelength of 100 nm to 400 nm, such as 300 nm. In various embodiments, the laser pulse may have a wavelength of 700 nm to 3000 nm and 2000 nm to 4000 nm, such as, for example, 800 nm and 2940 nm. In various embodiments, the laser pulse may have a wavelength of 2 μm to 4 μm, such as, for example, about 3 μm. In various embodiments, the laser pulse may have a diameter of 0.5 mm to 1 mm, 1 mm to 20 mm, and 1 mm to 5 mm before focusing. In various embodiments, the laser pulse may have a pulse length of 200 fs to 10 ns, 1 ns to 100 ns, and 1 ns to 5 ns. In various embodiments, the laser pulse may have a repetition rate up to 100 Hz, such as, for example, 0.1 Hz to 100 Hz. In at least one embodiment, the laser pulse may have a wavelength of 800 nm, a diameter of 1 mm, and a pulse length of 200 fs. In at least one embodiment, the laser pulse may have a wavelength of 100 nm to 400 nm, a diameter of 1 mm to 5 mm, and a pulse length of 1 ns to 100 ns. In at least one embodiment, the laser pulse may have a wavelength of 2940 nm, a diameter of 1 to 20 mm, and a pulse length of 5 ns. In at least one embodiment, the laser may comprise a mid-infrared pulsed laser operating at a wavelength from 2600 nm to 3450 nm, a diameter of 1 to 20 mm, a pulse length from 0.5 ns to 50 ns, and a repetition rate from 1 Hz to 100 Hz. The energy of a laser pulse before coupling into the optical fiber may be from 0.1 mJ to 6 mJ, and the pulse-to-pulse energy stability generally corresponds to 2% to 10%. In at least one embodiment, the energy of a laser pulse before coupling into the optical fiber may be 554±26 μJ, thus the pulse-to-pulse energy stability corresponds to 5%. The laser system may be operated at 100 Hz for a period from 0.01 seconds to 20 seconds to ablate a sample. In at least one embodiment, laser system may be operated at 100 Hz for a period of 1 second to ablate a sample. In certain embodiments, 1 to 100 laser pulses may be delivered to ablate a sample.

Figure 7:
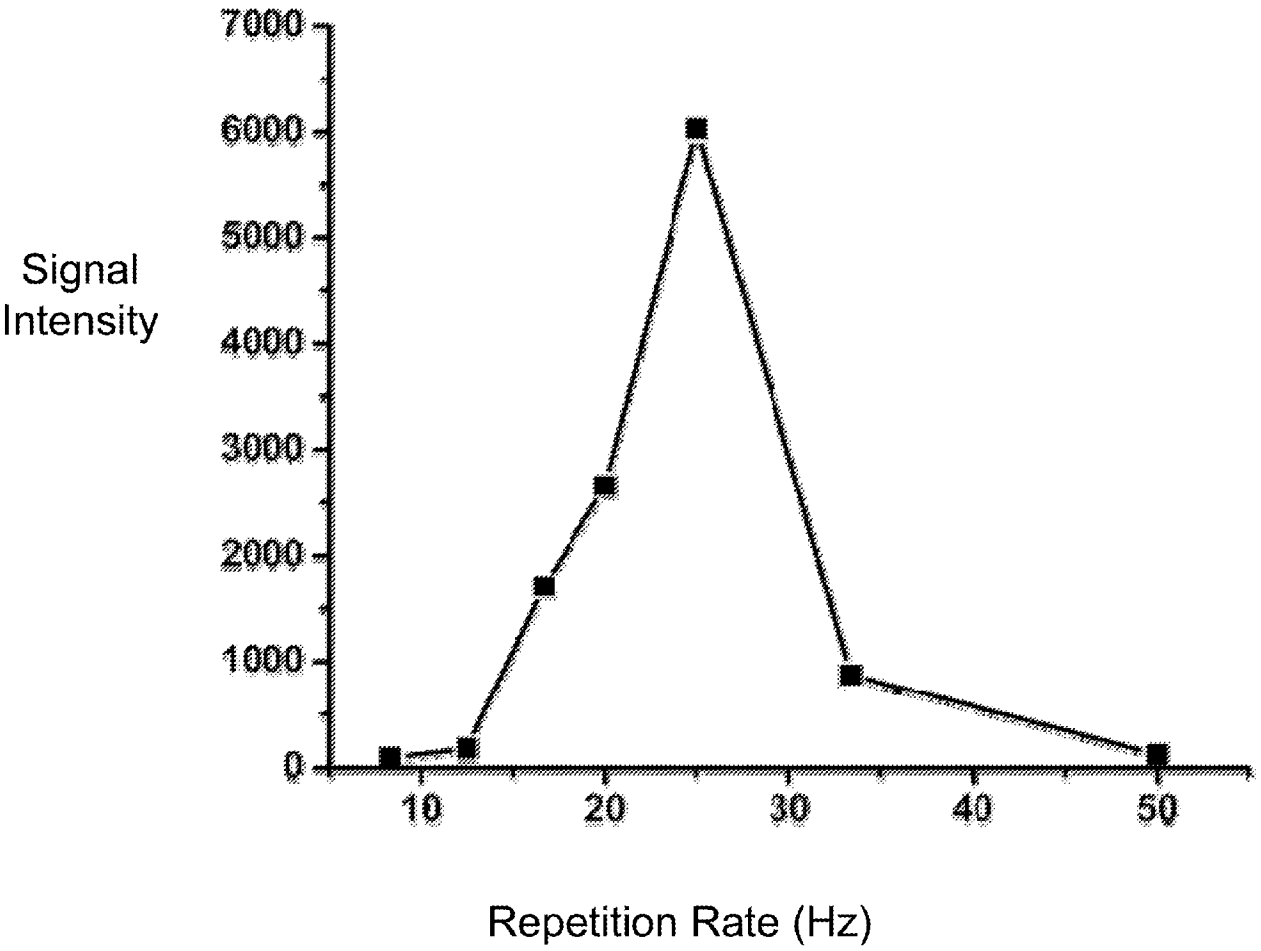
FIG. 7 includes a graph plotting signal intensity and laser repetition rate (Hz) according to various embodiments described herein.

In various embodiments, the signal intensity may relate to the repetition rate of the laser pulse. Without wishing to be bound to any particular theory, the repetition rate may affect the ablation plume kinetics and/or ablation plume dynamics during plume collimation. The signal intensity and repetition rate may relate to laser, the laser pulse, the dimensions of the optical fiber, the dimensions of the capillary, and/or sample volume. For example, FIG. 7 shows a graph plotting the signal intensity and laser repetition rate (Hz) for a 1.5 μL of $1\times10^{-4}$M verapamil solution comprising 50% (v/v) water and 50% (v/v) methanol in a capillary including an inner diameter of 1 mm and a length of 4.2 mm. As shown in FIG. 7, a repetition rate of about 25 Hz may generate the highest signal intensity. In various embodiments, the laser pulse may have a repetition rate from 1 Hz to 100 Hz, such as, for example, up to 50 Hz, 0.1-50 Hz, 5-50 Hz, 15-35 Hz, 20-30 Hz, 20-25 Hz, 25-30 Hz, 22-28 Hz, 23-27 Hz, and 25 Hz. In at least one embodiment, the laser pulse may have a repetition rate from 20 Hz to 30 Hz. In at least one embodiment, the laser pulse may have a repetition rate of 25 Hz.

In various embodiments, the laser may be selected from the group consisting of a UV laser, a laser emitting visible radiation, and an infrared laser, such as, for example, a mid-infrared laser. The UV laser may include, but is not limited to, an excimer laser, a frequency tripled Nd:YAG laser, a frequency quadrupled Nd:YAG laser, and a dye laser. The laser emitting visible radiation may include, but is not limited to, a frequency doubled Nd:YAG laser, and a dye laser. The infrared laser may include, but is not limited to, a carbon dioxide laser, a Nd:YAG laser, and a titanium-sapphire laser. The laser may comprise a tunable titanium-sapphire mode-locked laser to generate laser pulses having a 800 nm wavelength, a 1 mm diameter, 200 fs pulse length, 76 MHz repetition rate, and 5 nJ energy per pulse. The laser system may comprise a tunable titanium-sapphire mode-locked laser and a regenerative amplifier associated with the titanium-sapphire laser to generate laser pulses having a 800 nm wavelength, 200 fs pulse length, 1 kHz repetition rate, and 1 mJ energy per pulse. A tunable titanium-sapphire mode-locked laser is commercially available from Coherent (Santa Clara, Calif.) under the trade designation Mira 900. A regenerative amplifier is commercially available from Positive Light (Los Gatos, Calif.) under the trade designation Spitfire.

In various embodiments, the mid-infrared laser may comprise one of an Er:YAG laser and a Nd:YAG laser driven optical parametric oscillator (OPO). The mid-infrared laser may operate at a wavelength from 2600 nm to 3450 nm, such as 2800 nm to 3200 nm, and 2930 nm to 2950 nm. The laser may comprise a mid-infrared pulsed laser operating at a wavelength from 2600 nm to 3450 nm, in a pulse on demand mode, or with a repetition rate from 1 Hz to 5000 Hz, and a pulse length from 0.5 ns to 100 ns. In various embodiments, the laser pulse may have a wavelength at an absorption band of an OH group. In various embodiments, the mid-infrared laser may comprise a diode pumped Nd:YAG laser-driven optical parametric oscillator (OPO) (Vibrant IR, Opotek, Carlsbad, Calif.) operating at 2940 nm, 100 Hz repetition rate, and 5 ns pulse length.

In various embodiments, the focusing system may comprise one or more mirrors, one or more coupling lenses, and/or an optical fiber. The laser pulse may be steered by gold-coated mirrors (PF10-03-M01, Thorlabs, Newton, N.J.) and coupled into the cleaved end of the optical fiber by a plano-convex calcium fluoride lens (Infrared Optical Products, Farmingdale, N.Y.) having a focal length from 1 mm to 100 mm, such as 25 mm to 75 mm, and 40 mm to 60 mm. In at least one embodiment, the focal length of the coupling lens may be 50 mm. In certain embodiments, the optical fiber may comprise at least one of a $GeO_2$-based glass fiber, a fluoride glass fiber, and a chalcogenide fiber. In various embodiments, the optical fiber may comprise a germanium oxide ($GeO_2$)-based glass optical fiber (450 μm core diameter, HP Fiber, Infrared Fiber Systems, Inc., Silver Spring, Md.) and the laser pulse may be coupled into the optical fiber by a plano-convex $CaF_2$ lens (Infrared Optical Products, Farmingdale, N.Y.). A high-performance optical shutter (SR470, Stanford Reseach Systems, Inc., Sunnyvale, Calif.) may be used to select the laser pulses. One end of the optical fiber may be held by a bare fiber chuck (BFC300, Siskiyou Corporation, Grants Pass, Oreg.) attached to a five-axis translator (BFT-5, Siskiyou Corporation, Grants Pass, Oreg.) or a micromanipulator (MN-151, Narishige, Tokyo, Japan) to adjust the distance between the fiber tip and the sample.

In various embodiments, the device may comprise a visualization system. In various embodiments, the visualization system may comprise a video microscope system. In case of transparent sample capillaries, the distance between the fiber tip and sample surface may be monitored by a long distance video microscope positioned orthogonal to the capillary (InFocus Model KC, Infinity, Boulder Colo.) with a 5× infinity corrected objective lens (M Plan Apo 5×, Mitutoyo Co., Kanagawa, Japan), and the image may be captured by a CCD camera (Marlin F131, Allied Vision Technologies, Stadtroda, Germany). When the environmental vibration is in the low micrometer range, an approximate distance from 30 μm to 40 μm may be maintained between the fiber tip and the sample. A similar video microscope system may be positioned on axis with the capillary to align the fiber tip within the capillary over the location of interest in the sample for ablation. The visualization system may comprise a 7× precision zoom optic (Edmund Optics, Barrington, N.J.), fitted with a 5× infinity-corrected long working distance objective lens (M Plan Apo 5×, Mitutoyo Co., Kanagawa, Japan) or a 10× infinity-corrected long working distance objective lens (M Plan Apo 10×, Mitutoyo Co., Kanagawa, Japan) and a CCD camera (Marlin F131, Allied Vision Technologies, Stadtroda, Germany). During this alignment, a HeNe laser beam may be coupled into the optical fiber to highlight the position of the fiber tip. The HeNe laser beam may replace the mid-IR laser beam during this alignment.

In various embodiments, the electrospray apparatus may comprise a low noise syringe pump 11 (Physio 22, Harvard Apparatus, Holliston, Mass.) to supply the electrospray solution to a tapered emitter 9 (inner diameter 50 μm, MT320-50-5-5, New Objective, Woburn, Mass.) at a constant flow rate. The low noise syringe pump 11 may supply the electrospray solution at a rate from 10 nL/min to 100 μL/min, such as, for example, 200 nL/min and 300 nL/min. The tapered emitter 9 may have an outside diameter from 100 μm to 500 μm and an inside diameter from 10 μm to 200 μm. The power supply 10 (PS350, Stanford Research Systems, Sunnyvale, Calif.) may comprise a regulated power supply to provide a stable high voltage from 0 to 5 kV to the electrospray emitter, such as, for example, 2,500 V and 3,100 V. The electrospray solution may comprise at least one of 50% (v/v) methanol with 0.1% (v/v) acetic acid, 50% (v/v) methanol with 0.1% (v/v) formic acid, 50% (v/v) methanol with 0.1% (v/v) trifluoroacetic acid, 50% (v/v) methanol with 0.1% (w/v) ammonium acetate. In various embodiments, to generate the electrospray plume, the electrospray solution may comprise 50% (v/v) aqueous methanol solution with 0.1% (v/v) acetic acid pumped through the tapered emitter 9 at a flow rate of 300 nL/min by the syringe pump 11 and 3,100 V may be applied by the power supply 10.

In certain embodiments, the atmosphere and/or the electrospray solution may comprise a reactant to facilitate the ionization and/or fragmentation of certain constituents of the sample. The electrospray solution may comprise reactants to facilitate ion formation or to produce ions with desirable properties (e.g., with enhanced fragmentation properties). For example, the electrospray solution may comprise $Li_2SO_4$ to facilitate the structural identification of lipids by inducing structure specific fragmentation in collision induced dissociation experiments. Examples of reactive gases include, but are not limited to, ammonia, $SO_2$, and $NO_2$.

The ions may be detected and/or analyzed by a mass spectrometer. The mass spectrometer may comprise an orthogonal acceleration time-of-flight mass spectrometer (Q-TOF Premier, Waters Co., MA). The orifice of the mass spectrometer may have an inner diameter from 100 μm to 500 μm, such as, for example, 225 μm to 375 μm. In at least one embodiment, the orifice of the mass spectrometer may have an inner diameter from 100 μm to 200 μm, such as, for example, 127 μm. The orifice of the mass spectrometer may be extended by a straight or curved extension tube having a similar inner diameter as the orifice of the mass spectrometer and a length from 20 mm to 500 mm. The interface block temperature may be from ambient temperature to 150° C., such as, for example, 23° C. to 90° C. and 60° C. to 80° C. In at least one embodiment, the interface block temperature may be 80° C. The potential may be from −100 V to 100 V, such as, for example, −70 V to 70 V. In at least one embodiment, the potential may be −70 V. Tandem mass spectra may be obtained by collision activated dissociation (CAD) with a collision gas, such as argon, helium or nitrogen, at a collision cell pressure from $10^{-6}$ mbar to $10^{-2}$ mbar, and with collision energies from 10 eV to 200 eV. In at least one embodiment, the collision gas may be argon, the collision cell pressure may be $4\times10^{-3}$ mbar, and the collision energies may be from 10 eV to 25 eV.

In various embodiments, the device may comprise one of transmission geometry and reflection geometry. In reflection geometry, the laser and ablation plume may be on the same side of the sample. For example, the laser may be positioned on one side of the sample and the ablation plume may be generated on the same side. In transmission geometry, the laser may be positioned on a first side of the sample and the ablation plume may be generated on a second side of the sample. For example, the laser may emit energy at the rear of the sample to generate an ablation plume on the front of the sample. In transmission geometry, at least a portion of the ablation plume or at least a substantial portion of the ablation plume may be on a side opposite from the laser, and at least a portion of the ablation plume or no portion of the ablation plume may be on the same side as the laser.

In transmission geometry, the ablation plume may be generated in the capillary. The ablation plume may travel in a forward direction away from the sample toward the open end of the capillary. The ablation plume may travel in a forward direction congruent and/or parallel to the laser pulse. The capillary may radially confine the ablation plume. The ablation plume may comprise a collimated ablation plume. The ablation plume may comprise a collinear ablation plume. The ablation plume may not be hemispherical. The ablation plume may not be freely expanding. The capillary may be oriented toward the electrospray plume. The ablation plume may be ejected from the capillary toward the electrospray plume. The ablation plume may be intercepted by an electrospray plume and ionized to generate ions detectable by the mass spectrometer.

Figure 8:
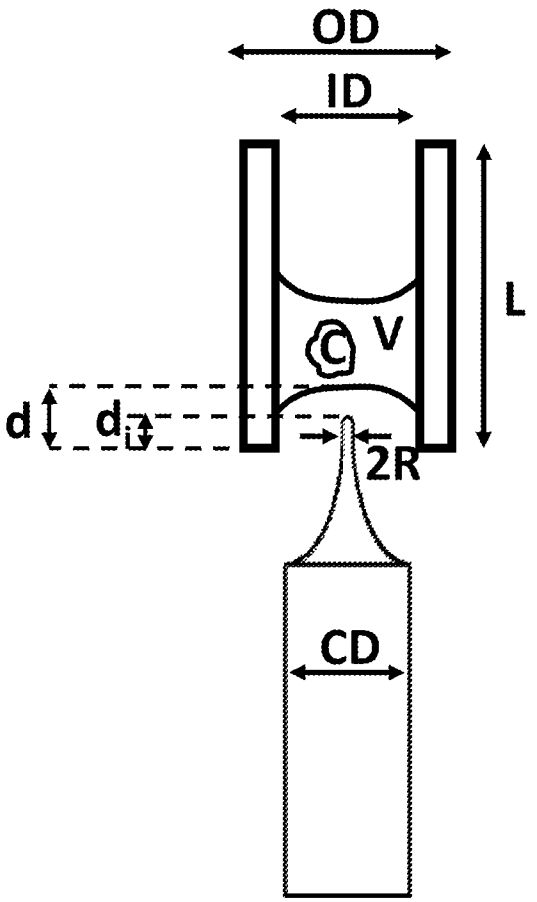
FIG. 8 includes a schematic and geometrical parameters of radially confined ablation in transmission geometry for plume collimation according to various embodiments described herein.

In transmission geometry, the capillary dimensions, sample volume, sample position in the capillary, position of the optical fiber relative to the capillary and/or sample, and position of the capillary relative to the electrospray apparatus and/or mass spectrometer orifice may be optimized to improve ion production. Referring to FIG. 8, the capillary may comprise an outer diameter (OD), an inner diameter (ID), and a length (L). The capillary may have an outer diameter (OD) from 7 mm to 100 μm, such as, for example 2 mm or 1 mm. The capillary may have an inner diameter (ID) from 5 μm to 5 mm, 10 μm to 1000 μm, 10 μm to 30 μm, and 30 μm to 50 μm. The capillary may have a length (L) from 0.1 mm to 10 mm, 0.5 mm to 5 mm, and 0.1 mm to 1 mm. The capillary may comprise a sample, such as, for example a single cell (C) suspended in a liquid, such as an aqueous solution, having a sample volume (V). The sample may have a sample volume from 1 picoliter to 100 μL, 5 picoliters to 5 nL, 5 nL to 500 nL, 10 nL to 100 nL, 100 nL to 1 μL, and 1 μL to 100 μL. In at least one embodiment, the sample volume may be 100 nL to 100 μL, 100 nL to 1 μL, and 0.5 μL. The sample may be positioned in a liquid where the distance from the end of the capillary to the lower meniscus of the liquid (d) may be from 0-10 mm, such as, for example, 0 to 1 mm, greater than 0 to 1 mm, 0.25 mm, 0.5 mm, 0.75 mm, and 1 mm. Referring to FIG. 8, in various embodiments, the focusing optics may comprise an optical fiber having a core diameter (CD), a tip radius of curvature (R), a tip-to-liquid distance ($d-d_i$) and a tip insertion depth ($d_i$). The optical fiber core diameter (CD) may be from 15 μm to 450 μm, such as, for example, 150 μm, 250 μm, 350 μm, and 450 μm. The tip radius of curvature (R) may be from 0.1 μm to 25 μm, such as, for example, 0.25 μm to 5 μm and 7.5 to 12.5 μm. The tip insertion depth ($d_i$) may be from 0 mm to 10 mm, such as, for example, greater than 0 to 10 mm, 5 mm, 1 mm, and 0.5 mm. For example, the tip insertion depth ($d_i$) may be 0 mm when the tip is not inserted into the capillary. The tip-to-liquid distance ($d-d_i$) may be from 0 μm to 50 μm, such as, for example, greater than 0 to 50 μm, 1 μm, 2 μm, 5 μm, 10 μm, and 30 μm. For example, the tip-to-liquid distance ($d-d_i$) may be 0 μm when the tip contacts the lower meniscus of the liquid. In various embodiments, the fiber tip may contact the sample ($d-d_i=0$ μm). In at least one embodiment, the tip-to-liquid distance ($d-d_i$) may be twice the tip radius of curvature (2R).

Figure 9C:
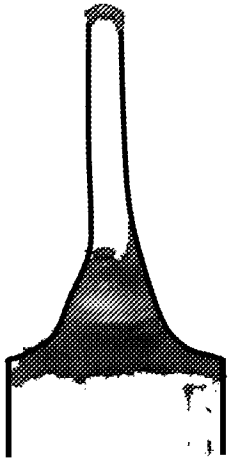
FIGS. 9A-C include illustrations of etched fibers tips for mass spectrometry systems according to various embodiments described herein.
Figure 9B:
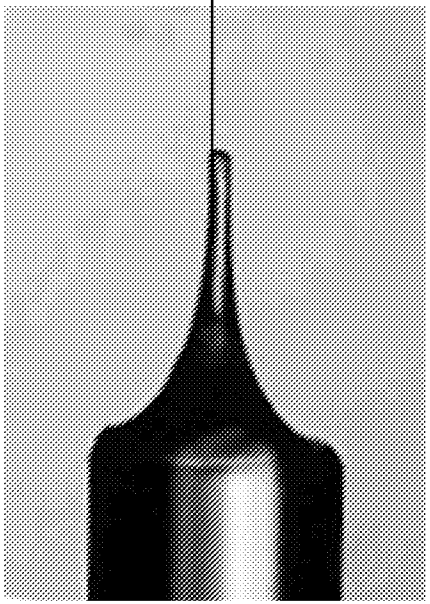
Figure 9A:
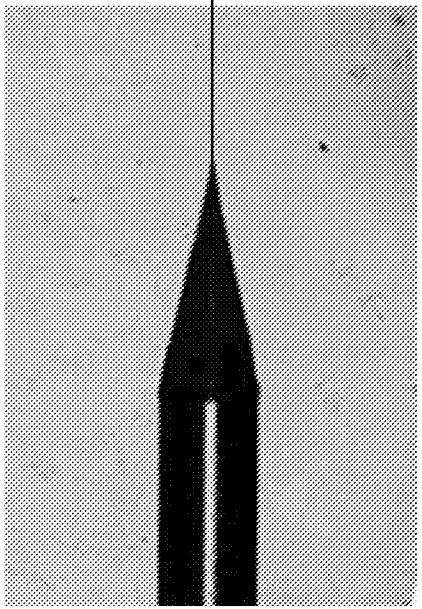

Referring to FIGS. 9A-C, in various embodiments, the device may comprise one of a linearly tapered tip 50 and a curved tapered tip 55. As shown in FIGS. 9A and 9B, the change in the radius of a linearly tapered tip from the core diameter of the optical fiber to the diameter of the tip is small relative to the change in the radius of a curved tapered tip. The energy (illustrated in gray) emitted from a curved tapered tip is illustrated in FIG. 9C. As shown in FIG. 9C, a significant portion of the laser energy may be emitted from the curved portion of the tip and/or the tip. Without wishing to be bound to any particular theory, the linearly tapered tip may exhibit less energy loss than the curved tapered tip. The linearly tapered tip may provide more focused laser energy delivery to the sample relative to a curved tapered tip. In various embodiments, the tip may comprise a metal coating, such as, for example, a silver coating, along the interior of the tip to reduce energy loss. In various embodiments, the fiber may be heated and/or drawn with a capillary puller to generate a linearly tapered tip including a controlled taper angle. Without wishing to be bound to any particular theory, a tapered tip may be characterized focusing all or substantially all of its laser energy at the tip and/or minimizing energy losses to provide more efficient sample ablation relative to a conventional tip.

In various embodiments, the device may comprise a capillary including a chemically modified interior surface. The chemically modified surface may increase and/or decrease an interaction between the capillary and sample. The capillary may comprise a hydrophobic inner surface. The capillary may comprise a hydrophilic inner surface. The capillary may be modified using hydrophobic agents and/or hydrophilic agents, such as, for example, but not limited to, pentafluorophenyldimethylchlorosilane, phenethylsilane, trimethylsilane, hexamethyldisilazane, 3-aminopropyldimethylethoxysilane, and combinations thereof.

In various embodiments, the sample may comprise subcellular components, a single cell, cells, small cell populations, cell lines, and/or tissues. The single cell may have a smallest dimension less than 100 micrometers, such as less than 50 μm, less than 25 μm, and/or less than 10 μm. The single cell may have a smallest dimension from 1 μm to 100 μm, such as, for example, from 5 μm to 50 μm, and 10 μm to 25 μm. In various embodiments, the single cell may have a smallest dimension from 1 μm to 10 μm. The small cell population may comprise 10 cells to 1 million cells, such as 50 cells to 100,000 cells, and 100 cells to 1,000 cells. The subcellular component may comprise one or more of cytoplasm, a nucleus, a mitochondrion, a chloroplast, a ribosome, an endoplasmic reticulum, a Golgi apparatus, a lysosome, a proteasome, a peroxisome, a secretory vesicle, a vacuole, and a microsome. In various embodiments, the sample may comprise an aqueous droplet. In various embodiments, the sample may comprise an aqueous droplet comprising subcellular components, a single cell, cells, small cell populations, cell lines, and/or tissues. In various embodiments, the sample may comprise subcellular components, a single cell, cells, small cell populations, cell lines, and/or tissues suspended in an aqueous droplet. The sample may comprise a hydrophobic sample and/or a hydrophilic sample. The sample may comprise one of a solid sample, a liquid sample, and a solid suspended in an aqueous droplet.

In various embodiments, the sample may comprise water. For example, tissue, cells and subcellular components may comprise water. The sample may comprise a high, native water concentration. The sample may comprise a native water concentration. In various embodiments, the sample may comprise one of a cell and a small cell population suspended in an aqueous solution. The aqueous solution may comprise water, a buffer, such as, for example, HEPES or PBS, cell culture media, such as, for example, RPMI 1640, BME, and Ham's F-12, and/or any other suitable solution. The sample may comprise a rehydrated sample. The sample may comprise a dehydrated sample rehydrated with an aqueous solution. In various embodiments, the rehydrated sample may be rehydrated via an environmental chamber and/or an aqueous solution. The sample may comprise water and the laser energy may be absorbed by the water in the sample. The sample may be in a native environment and/or ambient environment.

Figure 10B:
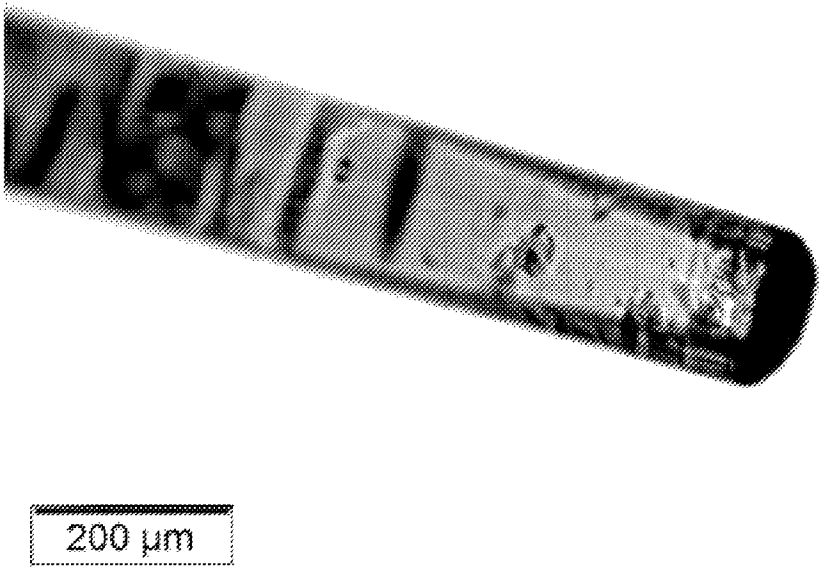
FIG. 10B includes an image of about fifteen (15) squamous epithelial cells after being drawn into a hollow glass capillary by capillary forces according to various embodiments described herein.
Figure 10A:
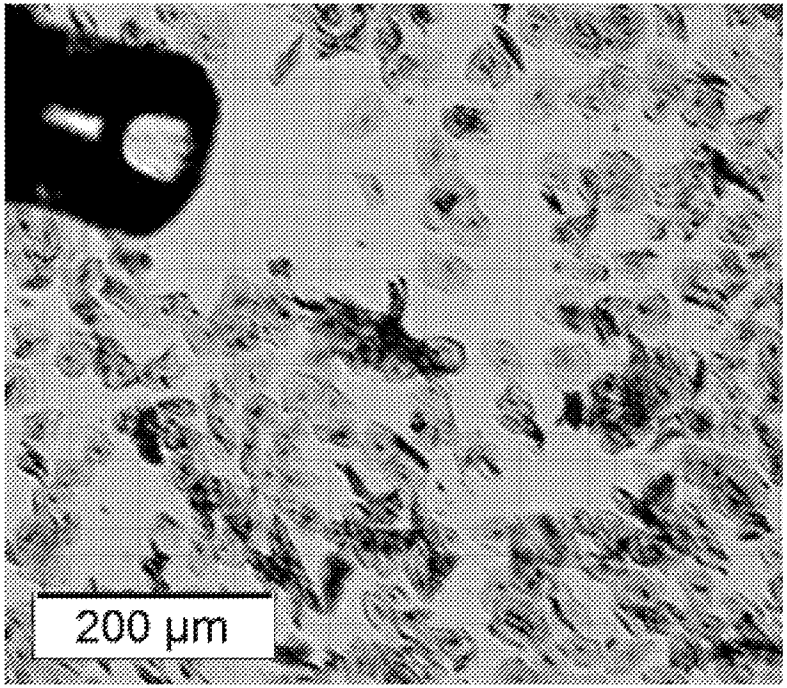
FIG. 10A includes an image of a glass capillary inserted into a water droplet comprising cells according to various embodiments described herein.

In various embodiments, the capillary may be used to select a sample for ablation and/or retrieve a sample for ablation. The capillary may be used to capture the sample from a native environment. As shown in FIG. 10A, a pulled glass capillary having an inner diameter of about 100 μm may be used to capture cells by capillary action. As shown in FIG. 10B, the capillary extracted about 15 cells. The capillary may use capillary forces to select a sample for ablation and/or retrieve a sample for ablation. The capillary may extract a liquid sample, a small cell population, and/or a single cell, and/or a subcellular component into an opening of the capillary via capillary forces. For example, the capillary may extract untreated biological fluids, cells, subcellular components, and tissue components from a sample in an ambient environment for direct ablation. The extracted sample may be positioned intermediate a first end of the capillary and a second end of the capillary.

The capillary may have different inner diameters to correspond to the sample volume. For example, the capillary may have an inner diameter comparable to a single mammalian cell. Without wishing to be bound to any particular theory, the inner diameter of the capillary may affect the selection and/or retrieval of the sample. For example, shearing forces may damage the cell when the diameter of capillary entrance is smaller than the size of the cell, and a capillary having a diameter greater than the size of a single cell may extract more than one cell. A capillary having a smaller inner diameter may exhibit improved plume collimation and sampling relative to a capillary having a larger inner diameter.

In various embodiments, the capillary may comprise a hollow waveguide. A method for making Ag/AgI hollow glass waveguides is described in U.S. Pat. No. 4,930,863, and Ag/AgI hollow glass waveguides having bore diameters greater than or equal to about 300 μm are commercially available from Polymicro Technologies, LLC. As discussed above, the waveguide may couple the laser energy to the sample, deliver the laser energy to the sample, collimate the ablation plume, select a sample for ablation, and/or retrieve a sample for ablation. The waveguide may be used to capture the sample from a native environment. The waveguide may use capillary forces to select a sample for ablation and/or retrieve a sample for ablation. For example, the waveguide may extract untreated biological fluids, cells, subcellular components, and tissue components from a sample in an ambient environment for direct ablation. The extracted sample may be positioned intermediate a first end of the waveguide and a second end of the waveguide. The waveguides may have different inner diameters to correspond to the sample volume. The waveguide may have the same dimensions as the capillary described above. For example, the waveguide may have an inner diameter comparable to a single mammalian cell.

Figure 11:
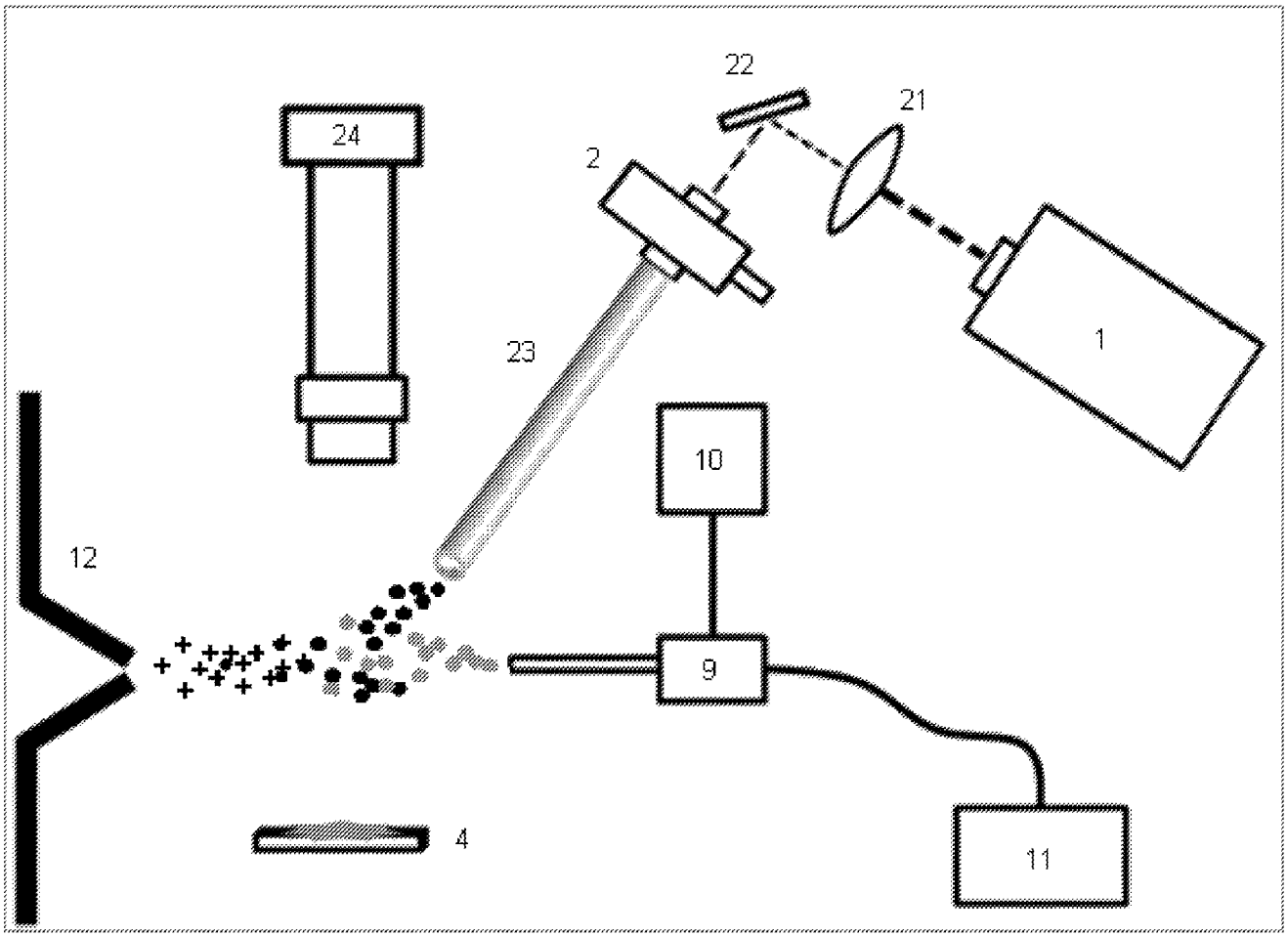
FIG. 11 includes illustrations of mass spectrometry systems according to various embodiments described herein.

Referring to FIG. 11, in certain embodiments, a mass spectrometer device may comprise a mid-infrared laser 1, such as, for example, a Nd:YAG laser driven optical parametric oscillator, a focusing system comprising a focusing device 21, such as, for example, a lens and a beam steering device 22, such as, for example, a mirror, a hollow waveguide held by a fiber mount 2, a three dimensional translation stage having a sample mount 4, an electrospray apparatus including an electrospray emitter 9, a syringe pump 11, a high voltage power supply 10, a mass spectrometer 12, and one or more long distance video microscopes 24 to visualize the sample when the sample is selected with the waveguide and/or when the sample is positioned for ablation. The waveguide may comprise the sample. The sample may be positioned intermediate the first end of the waveguide and the second end of the waveguide. The waveguide may deliver and/or couple the laser energy to the sample. The ablation plume may be generated in the waveguide. The ablation plume may travel in a forward direction toward the second end of the waveguide. The waveguide may radially confine the ablation plume. The ablation plume may comprise a collimated ablation plume. The collimated ablation plume may comprise a radially confined ablation plume. The collimated ablation plume may comprise a collinear ablation plume. The waveguide may be oriented toward the electrospray plume. The ablation plume may be ejected from the waveguide toward the electrospray plume.

In various embodiments, the mid-infrared laser pulse may have a beam diameter of about 65% of the waveguide bore diameter. The focusing lens may comprise a 50 mm focal length plano-convex calcium fluoride lens. The long distance video microscope 24 may be positioned orthogonal to the sample surface to visualize the sampling by the hollow waveguide. The waveguide may be maneuvered by a micromanipulator (not shown). The waveguide may contact a sample comprising a single cell or cells to select and/or capture the sample. The waveguide comprising the sample may be positioned for sample ablation. The electrospray solution may comprise 50% methanol solution and 0.1% acetic acid (v/v). Other electrospray solutions and/or gas environments may be used to enhance ion production and/or facilitate the fragmentation of the produced ions. The syringe pump 11 may deliver the electrospray solution at a rate of 300 mL/min. The high voltage power supply 10 may apply about 3,100 V to the electrospray emitter 9 to generate a steady electrospray plume. The distance and angle between the hollow waveguide 23 and the electrospray axis may be adjusted to optimize sampling conditions. In various embodiments, the distance between the hollow waveguide 23 and the electrospray axis may be 1-15 mm, such as, for example, 5 mm, 10 mm, or 12 mm, and the angle between the hollow waveguide 23 and the electrospray axis may be 0-180°, such as, for example, 90°, 45°, and 5°.

In various embodiments, a method may comprise ablating a sample by a laser pulse in a capillary to generate an ablation plume, intercepting the ablation plume by an electrospray plume to produce positive or negative ions, and detecting the ions by mass spectrometry, wherein the ablation plume is a collimated ablation plume. The collimated ablation plume may comprise a radially confined ablation plume. The collimated ablation plume may comprise a collinear ablation plume. In various embodiments, the capillary may comprise a hollow waveguide. In various embodiments, the method may comprise delivering the laser pulse to the sample by at least one of focusing optics, an optical fiber, and a hollow waveguide. The method may comprise coupling the laser pulse to the sample by at least one of focusing optics, an optical fiber, and a hollow waveguide. The laser pulse may comprise a mid-infrared laser pulse.

In various embodiments, the method may comprise generating an ablation plume in the capillary. The method may comprise generating a radially confined ablation plume. The method may comprise generating a collimated ablation plume. The method may comprise generating a collinear ablation plume. The method may comprise collimating the ablation plume with one of the capillary and a hollow waveguide. As shown in FIG. 1B, a capillary may collimate an ablation plume generated in the capillary. The capillary may reduce and/or eliminate the radial expansion of the ablation plume. The collimated ablation plume may improve ion formation and/or ion efficiency. The method may comprise generating an ablation plume in the hollow waveguide.

In various embodiments, the method may comprise ejecting at least a portion of the ablation plume from the capillary. The method may comprise ejecting at least a portion of the ablation plume from the second end of the capillary. The ablation plume may travel in a forward direction toward the second end of the capillary. The method may comprise ejecting at least a portion of the ablation plume from the second end of the capillary towards the electrospray plume. The method may comprise ejecting a radially confined ablation plume from the second end of the capillary. The method may comprise ejecting a collimated ablation plume from the second end of the capillary. The method may comprise ejecting a collinear ablation plume from the second end of the capillary. The method may comprise ejecting at least a portion of the ablation plume from the hollow waveguide.

In various embodiments, the method may comprise subjecting the sample to one of transmission geometry and reflection geometry ablation. In reflection geometry, the method may comprise delivering the laser pulse to a first side of the sample and generating the ablation plume on the first side of the sample. In transmission geometry, the method may comprise delivering the laser pulse to a first side of the sample and generating the ablation plume on a second side of the sample, such as, for example, an opposite side of the sample. For example, the method may comprise delivering the laser pulse to the rear of the sample and generating an ablation plume on the front of the sample. In transmission geometry, at least a portion of the ablation plume or at least a substantial portion of the ablation plume may be on a side opposite from the laser and at least a portion of the ablation plume or no portion of the ablation plume may be on the same side as the laser. In transmission geometry, the method may comprise ejecting at least a portion of the ablation plume on a side of the sample opposite from the laser.

In various embodiments, the method may comprise positioning the sample intermediate a first end of the capillary and the second end of the capillary. The method may comprise positioning the sample proximate to the first end of the capillary. The method may comprise positioning the sample adjacent to the first end of the capillary. The method may comprise positioning the sample outside the first end of the capillary. In various embodiments, the method may comprise one or more of selecting and retrieving a sample for ablation with the capillary. The method may comprise selecting and/or retrieving the sample from a native environment with the capillary using capillary forces. In various embodiments, retrieving the sample may comprise capturing the sample from a native environment with the capillary using capillary forces. As shown in FIG. 10A, for example, a capillary may be inserted into an aqueous droplet comprising cells to select one or more cells for ablation. As shown in FIG. 10B, the cell or cells may be drawn into the capillary by capillary forces.

Referring to FIGS. 5 and 6, in various embodiments, the method may comprise hydrodynamically focusing the sample in a stream of fluid. In various embodiments, a flow cytometer may hydrodynamically focus the sample in a stream of fluid. In various embodiments, a flow through capillary may hydrodynamically focus the sample in a stream of fluid. The hydrodynamically focused sample may comprise a single stream of cells. In various embodiments, the method may comprise hydrodynamically focusing the sample in a stream of fluid in a flow cytometer and/or a flow through capillary, irradiating the stream of fluid with a continuous laser on a first side of the capillary, detecting when the sample passes the focused beam from the continuous laser, and activating the mid-infrared laser when the sample is at a point of ablation in the capillary. A cell may deflect the focused beam emitted from the continuous laser 6. The detector may detect the deflected laser beam and activate the delay generator 8. The delay generator 8 may delay the activation of the mid-infrared laser 1 until the cell is at a point of ablation in the capillary. The delay generator may trigger the mid-infrared laser pulse to ablate the cell. The duration of the delay may be the time for the sample to travel from the point when the cell intercepts the continuous laser beam to the point of ablation proximate to or in the capillary. In various embodiments, the method may comprise labeling the sample with a fluorescent tag, such as, for example, green fluorescent protein, yellow fluorescent protein, immunofluorescent tag, or acridine orange dye. In various embodiments, the method may comprise subjecting the sample to cell sorting through flow cytometry prior to ablating the sample.

The various embodiments described herein may be better understood when read in conjunction with the following representative examples. The following examples are included for purposes of illustration and not limitation.

An optical parametric oscillator (OPO) (Vibrant IR or Opolette 100, Opotek, Carlsbad, Calif.) converted the output of a 100 Hz repetition rate $N_d$:YAG laser to mid-infrared laser pulses of about 5 ns pulse length at about 2940 nm wavelength. Individual laser pulses were selected using a high performance optical shutter (SR470, Standford Research Systems, Inc., Sunnyvale, Calif.). In certain embodiments, beam steering and focusing were accomplished by gold coated mirrors (PF10-03-M01, Thorlabs, Newton, N.J.) and a single 75 mm focal length plano-convex antireflection-coated ZnSe lens or a 150 mm focal length plano-convex $CaF_2$ lens (Infrared Optical Products, Farmingdale, N.Y.). In certain embodiments, beam steering and focusing were accomplished by a sharpened germanium oxide ($GeO_2$) optical fiber having a core diameter of 450 μm and a tip radius of curvature of 15 μm to 50 μm (HP Fiber, Infrared Fiber Systems, Inc., Silver Spring, Md.). The optical fiber was held in a bare fiber chuck (BFC300, Siskiyou Corp., Grant Pass, Oreg.) that was attached to a five-axis translator (BFT-5, Siskiyou Corporation, Grants Pass, Oreg.). The optical fiber was positioned in contact with the sample. The optical fiber may comprise a linearly tapered tip. In certain embodiments, beam steering and focusing were accomplished by a hollow waveguide having a 300 μm bore diameter manufactured by Polymicro Technologies, LLC. A 50 mm focal length plano-convex $CaF_2$ lens (Infrared Optical Products, Farmingtondale, N.Y.) was used to focus the laser pulse onto the distal end of the optical fiber or hollow waveguide.

The electrospray system comprised a low-noise syringe pump (Physio 22, Harvard Apparatus, Holliston, Mass.) to feed a 50% (v/v) aqueous methanol solution containing 0.1% (v/v) acetic acid at 200-300 nL/min flow rate through a tapered stainless steel emitter comprising a tapered tip having an outside diameter of 320 μm and an inside diameter of 50 μm. (MT320-50-5-5, New Objective Inc., Woburn, Mass.). Stable high voltage was generated by a regulated power supply (PS350, Stanford Research Systems, Inc., Sunnyvale, Calif.). The regulated power supply provided 3,000 V directly to the emitter. The orifice of the mass spectrometer sampling cone was on-axis with the electrospray emitter at a distance of about 12 mm from its tip.

An orthogonal acceleration time-of-flight mass spectrometer (Q-TOF Premier, Waters Co., Milford, Mass.) having a mass resolution of 8,000 (FWHM) collected and analyzed the ions generated by the LAESI source. No sample related ions were observed when the laser was off. The electrospray solvent spectra were subtracted from the LAESI spectra using the MassLynx 4.1 software (Waters Co., Milford, Mass.).

To visualize the sample, a video microscope having a 7× precision zoom optic (Edmund Optics, Barrington, N.J.), a 2× infinity-corrected objective lens (M Plan Apo 2×, Mitutoyo Co., Kanagawa, Japan), and a CCD camera (Marlin F131, Allied Vision Technologies, Stadtroda, Germany) was positioned on the capillary axis.

In certain embodiments, the ablation was performed in transmission geometry. In transmission geometry, the optical fiber was positioned inside the capillary from below and the ablation plume was ejected from the opposite end. The capillary axis was 6.5 mm in front of the electrospray emitter tip. The capillary end that ejected the ablation plume was 12 mm below the electrospray emitter axis. The inner diameter of the capillary was 1 mm and the length of the capillary was 3 mm.

Figure 12:
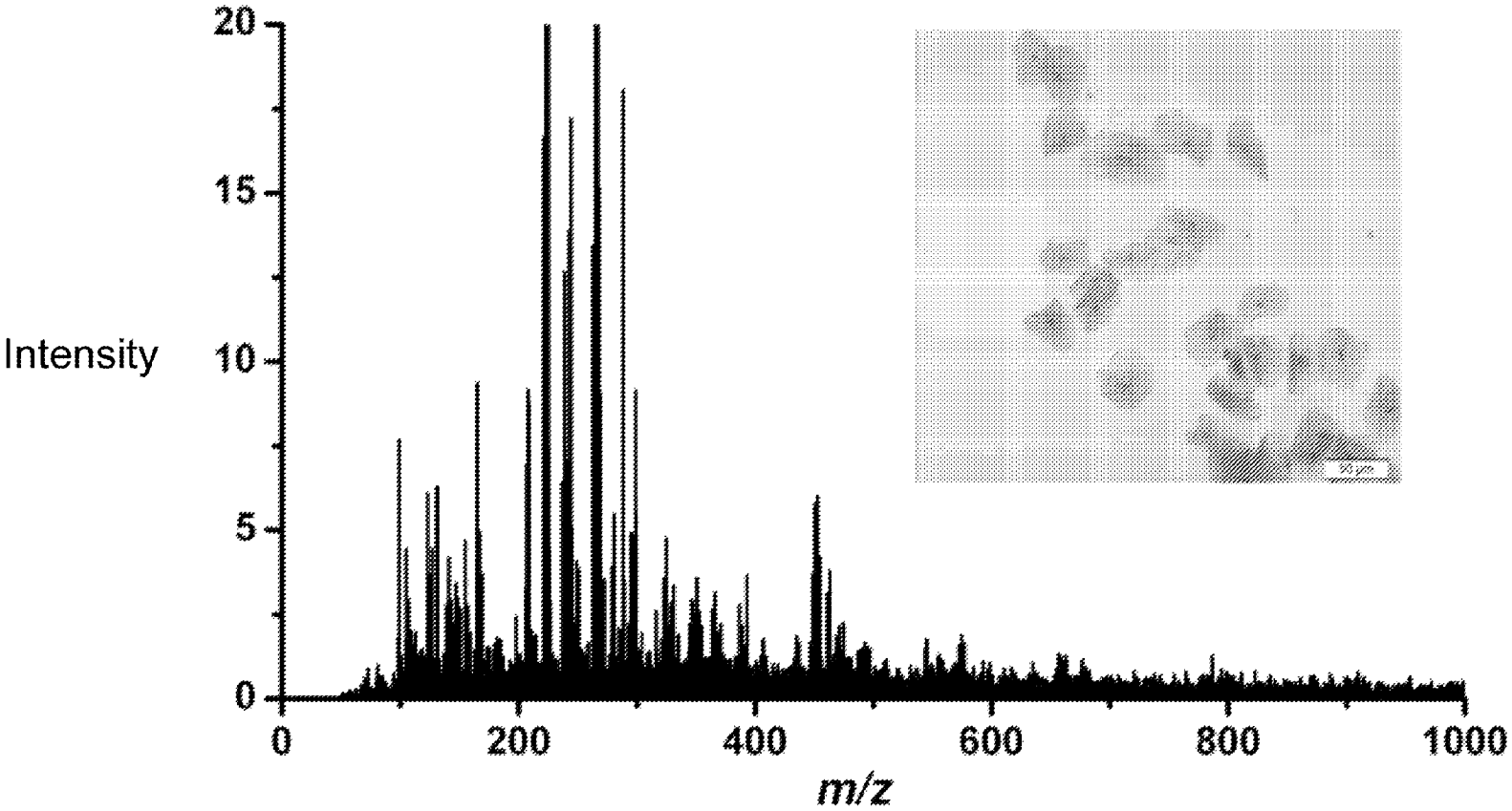
FIG. 12 includes a representative LAESI mass spectrum from about twenty-five (25) squamous epithelial cells according to various embodiments described herein. The inset in FIG. 12 includes an image of about twenty-five (25) stained squamous epithelial cells. The scale bar in the inset is 50 micrometers.
Figure 13:
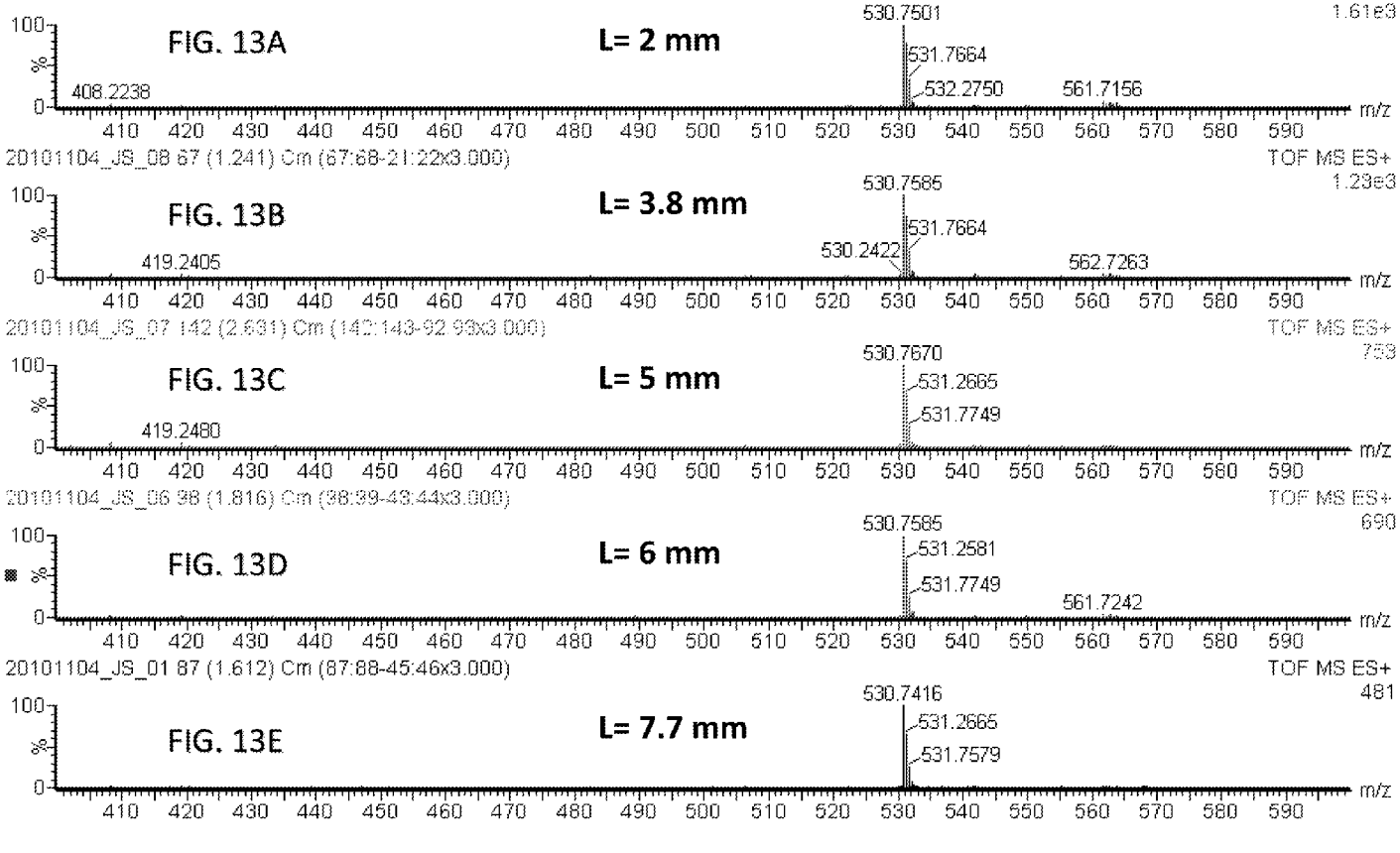
FIGS. 13A-E include representative LAESI mass spectra of bradykinin solution in capillaries having an inner diameter of 2 mm and a length of 2 mm, 3.8 mm, 5 mm, 6 mm, and 7.7 mm, respectively, according to various embodiments described herein.

Referring to FIG. 12, a representative mass spectrum in the range of 0-1000 m/z was obtained from about twenty-five (25) squamous epithelial cells. The squamous epithelial cells were suspended in a 2.5 μL droplet of water, positioned inside a capillary having an inner diameter of 1 mm and a length of 3 mm, and ablated by the mass spectrometric device in transmission geometry. The inset in FIG. 12 includes an image of about twenty-five (25) squamous epithelial cells stained with toluidine blue. The scale bar in the inset is 50 micrometers. About twenty-five (25) cells were selected from a large cell population by diluting the cell population in water until its density was sufficiently low such that the cells could be isolated and retrieved from the solution with the capillary. The total cell volume of a single cell, assuming a spherical shape, was about 10 picoliters to about 60 picoliters. The total cell volumes of the 25 cells, assuming a spherical shape, was about 25 times greater than the total cell volume of the single cell.

FIGS. 13A-E include representative mass spectra in the range of 0-600 m/z obtained from bradykinin dissolved in a 5 μL droplet of water. The samples were positioned inside capillaries having an inner diameter of 2 mm and lengths of 2 mm, 3.8 mm, 5 mm, 6 mm, and 7.7 mm, respectively, and ablated by the mass spectrometric device in transmission geometry. The optical fiber was inserted into the droplet from the bottom of the capillary prior to ablation. The total ion count for the representative mass spectrum of bradykinin was 1610, 1230, 753, 690, and 481, respectively. As shown in FIGS. 13A-E, the shorter capillaries generally exhibited improved ionization efficiencies relative to the longer capillaries. For example, the capillary having a length of 2 mm had the highest total ion count, and thereby, the highest ionization efficiency.

Figure 14:
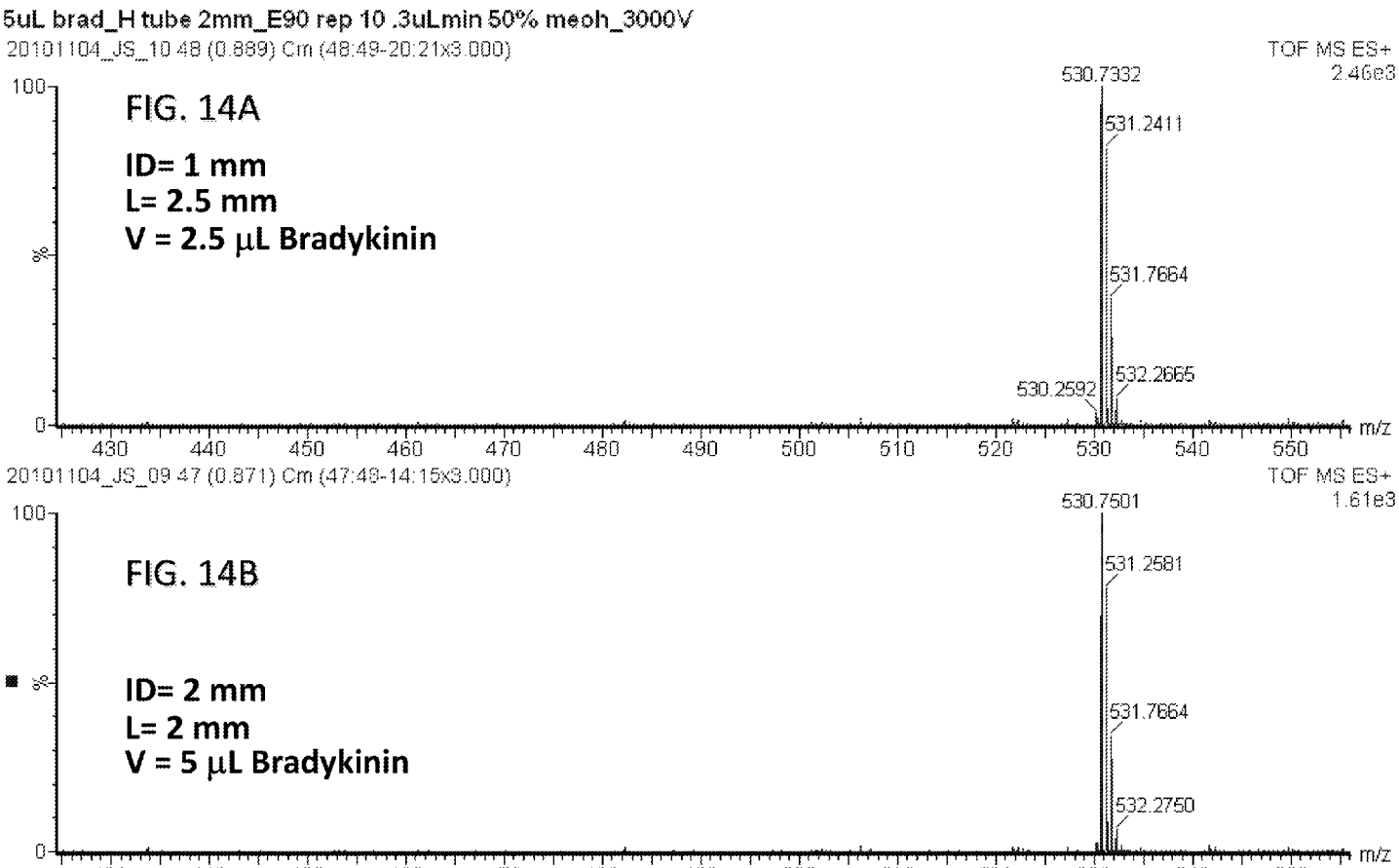
FIG. 14A includes a representative LAESI mass spectrum of 2.5 μL of 0.1 mM bradykinin solution comprising 50% (v/v) water and 50% (v/v) methanol in a capillary having an inner diameter of 1 mm and a length of 2.5 mm according to various embodiments described herein.
FIG. 14B includes a representative LAESI mass spectrum of 5 μL of 0.1 mM bradykinin solution comprising 50% (v/v) water and 50% (v/v) methanol in a capillary having an inner diameter of 2 mm and a length of 2 mm according to various embodiments described herein.

FIG. 14A includes a representative mass spectrum in the range of 0-600 m/z obtained from 2.5 μL of 0.1 mM bradykinin solution in a capillary having an inner diameter of 1 mm and a length of 2.5 mm. The sample was positioned inside the capillary and ablated by the mass spectrometric device in transmission geometry. The total ion count was 2460. FIG. 14B includes a representative mass spectrum in the range of 0-600 m/z obtained from 5 μL of 0.1 mM bradykinin solution in a capillary having an inner diameter of 2 mm and a length of 2.5 mm. The sample was positioned inside the capillary and ablated by the mass spectrometric device in transmission geometry. The total ion count was 1610. As shown in FIGS. 14A and 14B, capillaries having smaller inner diameters generally exhibited improved ionization efficiencies relative to capillaries having larger inner diameters. For example, the capillary having an inner diameter of 1 mm had the highest total ion count, and thereby, the highest ionization efficiency.

Figure 15:
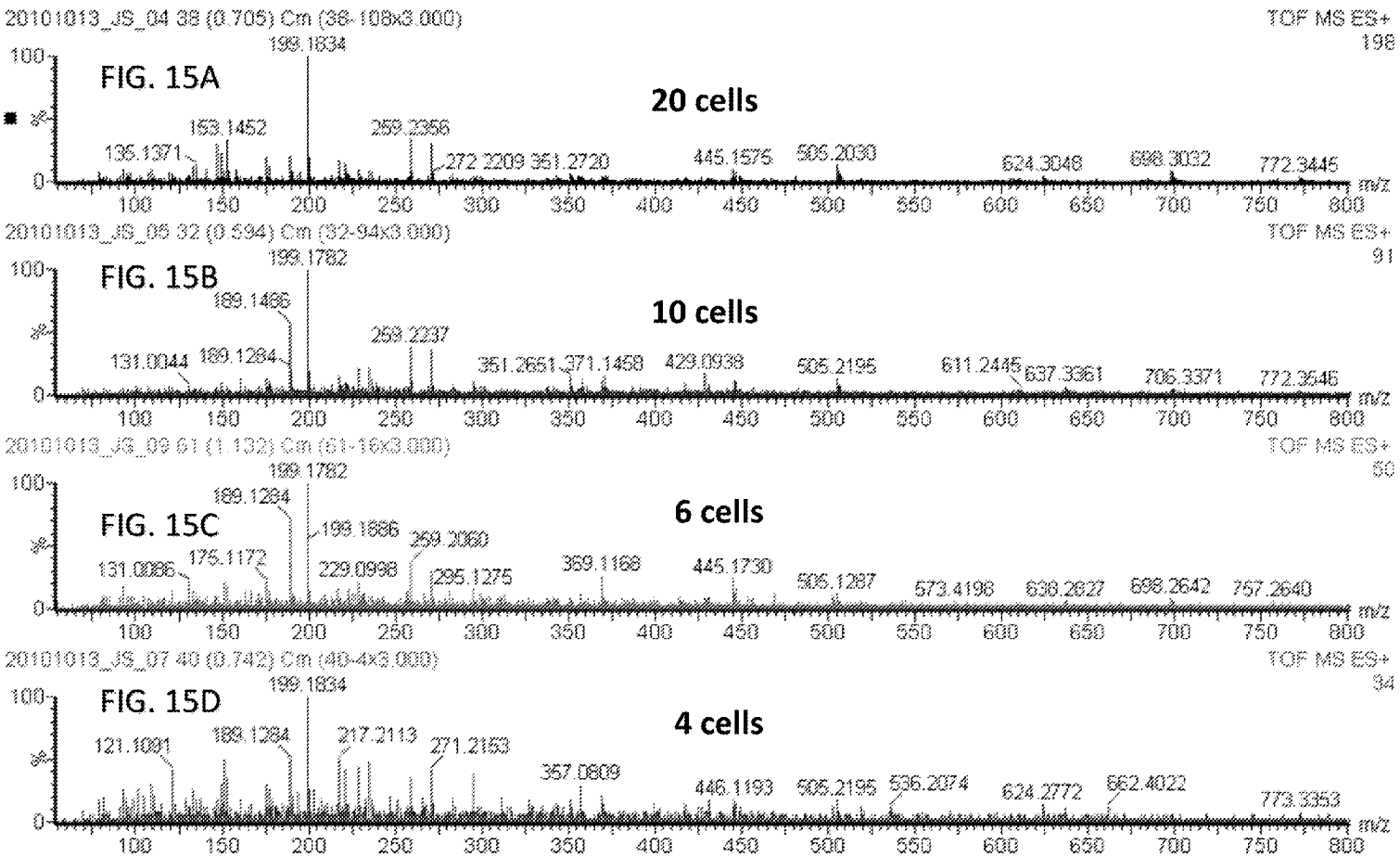
FIGS. 15A-D include representative LAESI mass spectra of squamous epithelial cells suspended in a droplet of water according to various embodiments described herein.

FIGS. 15A-D include representative mass spectra in the range of 0-800 m/z obtained from squamous epithelial cells suspended in a droplet of water. The samples were positioned inside a capillary having an inner diameter of 1 mm and a length of 3 mm and ablated by the mass spectrometric device in transmission geometry. FIG. 15A includes a representative mass spectrum of 20 squamous epithelial cells having a total ion count of 198. FIG. 15B includes a representative mass spectrum of 10 squamous epithelial cells having a total ion count of 91. FIG. 15C includes a representative mass spectrum of 6 squamous epithelial cells having a total ion count of 50. FIG. 15D includes a representative mass spectrum of 4 squamous epithelial cells having a total ion count of 34. As shown in FIG. 15D, a sample comprising 4 squamous epithelial cells exhibited improved ionization efficiencies sufficient to generate ions detectable by mass spectrometry. As shown in FIGS. 15A-D, the signal intensity generally decreased as the number of cells decreased.

Figure 16:
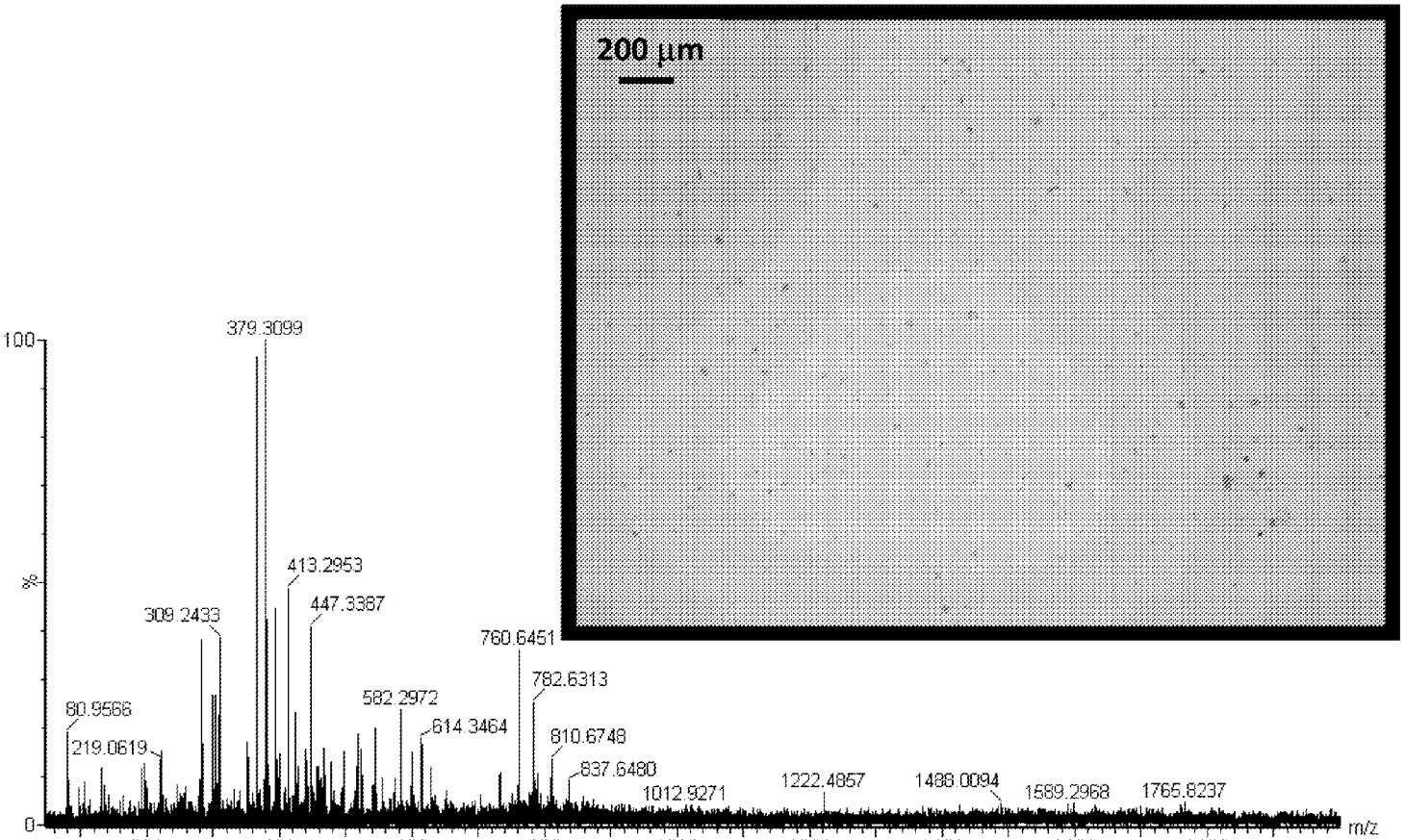
FIG. 16 includes representative LAESI mass spectrum of about less than 500 epithelial beta cells having a size of about 5-10 μm suspended in a 2.5 μL droplet of water in a capillary according to various embodiments described herein. The inset in FIG. 16 includes an image of a small cell population of about 550 epithelial beta cells prior to ablation.

FIG. 16 includes representative LAESI mass spectrum in the range of 0-2000 m/z obtained from about less than 500 epithelial beta cells having a size of about 5-10 μm suspended in a 2.5 μL droplet of water. The sample was positioned inside a capillary having an inner diameter of 1 mm and a length of 2.8 mm and ablated by the mass spectrometric device in transmission geometry. The inset in FIG. 16 includes an image of a small cell population of about 550 epithelial beta cells prior to ablation.

Figure 17:
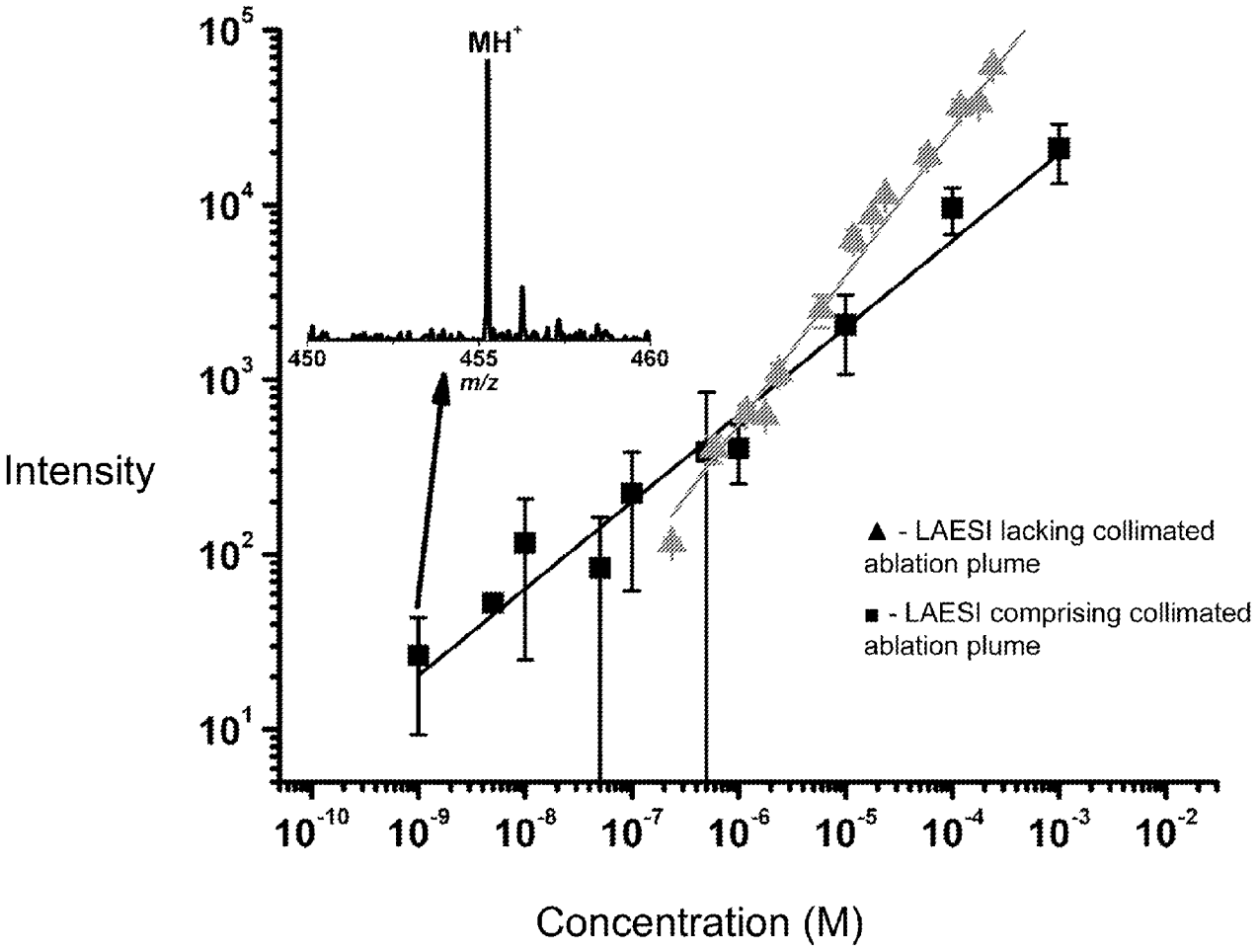
FIG. 17 includes a graph plotting signal intensity and concentration (M) for mass spectrometry systems according to various embodiments described herein and a mass spectrometry system lacking a collimated ablation plume. The inset in FIG. 17 includes representative LAESI mass spectrum of 0.5 μL of $1.2\times10^{-9}$M verapamil solution comprising 50% (v/v) water and 50% (v/v) methanol.

In various embodiments, the dynamic range and/or limit of detection may be improved relative to mass spectrometry systems lacking a collimated ablation plume. FIG. 17 includes a graph plotting signal intensity and concentration (molarity, M) for mass spectrometry systems according to various embodiments described herein and a mass spectrometry system lacking a collimated ablation plume. Without wishing to be bound to any particular theory, a collimated ablation plume may increase the dynamic range and/or limit of detection relative to a mass spectrometry system lacking a collimated ablation plume. As discussed above, mass spectrometry system lacking a collimated ablation plume may comprise a freely expanding ablation plume. A mass spectrometry system comprising a freely expanding ablation plume may be characterized by lower ionization efficiency, lower sensitivity, and/or lower limits of detection because the ablation plume may freely expand in three-dimensions and/or only a small portion of the ions is captured by the electrospray plume. In various embodiments, the capillary may reduce or eliminate the free radial expansion of the ablation plume and/or generate a collimated ablation plume. Without wishing to be bound to any particular theory, the collimated expansion of the ablation plume may generate higher ionization efficiency, higher sensitivity, and/or higher limits of detection because a greater portion of the ions may be captured by the electrospray plume. The collimated ablation plume may increase the overlap of the ablation plume and electrospray plume. As shown in FIG. 17, a mass spectrometry system according to various embodiments described herein (■) may comprise a dynamic range of 6 orders of magnitude and a limit of detection of 600 attomoles. However, a mass spectrometry system lacking a collimated ablation plume (▲) may comprise a dynamic range of 4 orders of magnitude and a limit of detection of 8 femtomoles. The inset in FIG. 17 includes representative LAESI mass spectrum of 0.5 μL of $1.2\times10^{-9}$M verapamil solution comprising 50% (v/v) water and 50% (v/v) methanol detected by a mass spectrometry system comprising plume collimation.

All documents cited herein are incorporated herein by reference, but only to the extent that the incorporated material does not conflict with existing definitions, statements, or other documents set forth herein. To the extent that any meaning or definition of a term in this document conflicts with any meaning or definition of the same term in a document incorporated by reference, the meaning or definition assigned to that term in this document shall govern. The citation of any document is not to be construed as an admission that it is prior art with respect to this application.

While particular embodiments of mass spectrometry have been illustrated and described, it would be obvious to those skilled in the art that various other changes and modifications can be made without departing from the spirit and scope of the invention. Those skilled in the art will recognize, or be able to ascertain using no more than routine experimentation, numerous equivalents to the specific apparatuses and methods described herein, including alternatives, variants, additions, deletions, modifications and substitutions. This application including the appended claims is therefore intended to cover all such changes and modifications that are within the scope of this application.

What is claimed is:

1. A device comprising transmission geometry, the device comprising:

at least one capillary including a first end having an inner diameter and a second end having an inner diameter, wherein the inner diameter of the first end is different from the inner diameter of the second end;

a pulsed, mid-infrared laser to emit energy at a sample in the capillary to ablate the sample and generate an ablation plume in the capillary;

an electrospray apparatus to generate an electrospray plume to intercept the ablation plume exiting the capillary to produce ions; and a mass spectrometer having an ion transfer inlet to capture the ions, wherein the mid-infrared laser is on a first side of the sample and at least a portion of the ablation plume is generated on a second side of the sample.

2. The device of claim 1, wherein the inner diameter of the first end is greater than the inner diameter of the second end.

3. The device of claim 1, wherein the first end is a closed end.

4. The device of claim 1, wherein the first end is a tapered end.

5. The device of claim 1, wherein the first end is a conical end.

6. The device of claim 1, wherein the sample is positioned adjacent the first end.

7. The device of claim 1, wherein the second end is an open end.

8. The device of claim 1, wherein the second end is a cylindrical end.

9. The device of claim 1, wherein the capillary is transparent.

10. The device of claim 1, wherein the inner diameter of the first end and inner diameter of the second end is independently selected from 5 micrometers to 5 mm.

11. The device of claim 1, wherein the capillary has a volume from 1 picoliter to 100 microliters.

12. The device of claim 1, wherein the capillary is configured to capture the sample from a native environment.

13. The device of claim 12, wherein the sample is captured by capillary action.

14. The device of claim 1 comprising a sample holder array, wherein the sample holder array comprises the at least one capillary.

15. The device of claim 14, wherein the sample holder array comprises an array of the at least one capillary.

16. The device of claim 14, wherein each of the at least one capillary comprises a well on the sample holder array.

17. The device of claim 14, wherein the sample holder array comprises a 384-well plate.

18. The device of claim 14, wherein the sample holder array comprises a plate for robotic manipulation.

19. A method comprising:

providing a plurality of capillaries, wherein each capillary comprises a closed end having an inner diameter and an open end having an inner diameter, wherein the inner diameter of the first end is different from the inner diameter of the second end;

positioning a sample adjacent the closed end of the capillary;

ablating the sample in the capillary by a mid-infrared laser pulse to generate an ablation plume in the capillary;

ejecting at least a portion of the ablation plume from the open end of the capillary on a side of the sample opposite from the mid-infrared laser;

intercepting the ablation plume by an electrospray plume after it exits from the capillary to produce ions; and detecting the ions by mass spectrometry;

wherein the ablation plume is a collimated ablation plume; and wherein the sample comprises water and the laser energy is absorbed by the water in the sample.

20. The method of claim 19 comprising collimating the ablation plume with the capillary to generate the collimated ablation plume.

* * * * *